US007819398B2

(12) United States Patent
Fukumasu

(10) Patent No.: US 7,819,398 B2
(45) Date of Patent: Oct. 26, 2010

(54) FEEDING APPARATUS AND RECORDING APPARATUS

(75) Inventor: Keiichiro Fukumasu, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/201,834

(22) Filed: Aug. 29, 2008

(65) Prior Publication Data

US 2009/0057988 A1 Mar. 5, 2009

(30) Foreign Application Priority Data

Aug. 31, 2007 (JP) ..... 2007-225601
Jun. 4, 2008 (JP) ..... 2008-146887

(51) Int. Cl.
*B65H 1/26* (2006.01)
*B65H 1/00* (2006.01)
*B65H 1/22* (2006.01)

(52) U.S. Cl. ..... 271/164; 271/162; 271/157

(58) Field of Classification Search ..... 271/145, 271/162, 164, 157
See application file for complete search history.

(56) References Cited

U.S. PATENT DOCUMENTS 4,017,181 A * 4/1977 Komaba et al. ..... 355/72
4,280,692 A * 7/1981 Hutchinson et al. ..... 271/160
4,623,137 A * 11/1986 Irie et al. ..... 271/160
4,854,570 A * 8/1989 Martin et al. ..... 271/162
5,222,725 A * 6/1993 Kasahara et al. ..... 271/160
5,292,116 A * 3/1994 Inoue et al. ..... 271/157
5,401,014 A * 3/1995 Okabe et al. ..... 271/255
5,419,544 A * 5/1995 Ono et al. ..... 271/164
5,501,444 A * 3/1996 Yukimachi et al. ..... 271/127
5,564,690 A * 10/1996 Oshida ..... 271/157
6,435,499 B1 * 8/2002 Tomatsu ..... 271/147
7,147,219 B2 * 12/2006 Soo ..... 271/157
7,448,613 B2 * 11/2008 Takahashi ..... 271/157
7,540,493 B2 * 6/2009 Konishi ..... 271/157
2010/0044956 A1 * 2/2010 Ko ..... 271/162

FOREIGN PATENT DOCUMENTS

JP 2006-103859 4/2006

* cited by examiner

*Primary Examiner*—Patrick MacKey
*Assistant Examiner*—Patrick Cicchino
(74) *Attorney, Agent, or Firm*—Workman Nydegger

(57) ABSTRACT

A feeding apparatus includes a cassette unit and a feeding-apparatus main body. The cassette unit can be mounted and dismounted to/from the feeding apparatus. The cassette unit includes a casing which is the base member of the cassette unit; a movable cassette hopper on which a housed recording medium is to be placed; and a locking section that holds the attitude of the cassette hopper. The feeding-apparatus main body includes a contact portion that comes into contact with the locking section to release the holding state when the cassette unit is mounted to the feeding-apparatus main body.

5 Claims, 26 Drawing Sheets

FEEDING APPARATUS AND RECORDING APPARATUS

BACKGROUND

1. Technical Field

The present invention relates to a feeding apparatus including a cassette unit that can be mounted and dismounted to/from the feeding apparatus, the cassette unit having a movable cassette hopper on which a housed recording medium is to be placed; and a locking section that holds the attitude of the cassette hopper and a recording apparatus equipped with the feeding apparatus.

Examples of the recording apparatus of this invention include an ink jet printer, a wire dot printer, a laser printer, a line printer, a copying machine, and a facsimile machine.

2. Related Art

As shown in JP-A-2006-103859, a cassette that can be mounted and dismounted to/from a recording-apparatus main body is generally composed of multiple components including a casing, an in-cassette hopper, a cover, and a shutter. The casing is a member for covering paper, which is an example of a recording medium, housed in a cassette. The in-cassette hopper is movable to move placed paper toward and away from the feed roller of the recording-apparatus main body.

The recording-apparatus main body has a hopper that can move toward and away from the feed roller. Accordingly, with the cassette mounted to the recording-apparatus main body, the in-cassette hopper can move toward and away from the feed roller by engaging with the hopper. This allows the feed roller to pick up and feed the paper.

However, the in-cassette hopper can move in the cassette in a state in which the cassette is dismounted from the recording-apparatus main body by the user. This may cause the in-cassette hopper to move during transportation. The movement of the in-cassette hopper may cause collision with the casing to generate pattering noise. The movement of the in-cassette hopper may also cause collision with the paper to damage the recording surface of the paper.

SUMMARY

An advantage of some aspects of the invention is to prevent bad effects caused by the movement of a cassette hopper of a cassette unit which is dismounted from a recording-apparatus main body.

According to an aspect of the invention, there is provided a feeding apparatus including a cassette unit that can be mounted and dismounted to/from the feeding apparatus and a feeding-apparatus main body. The cassette unit includes: a casing which is the base member of the cassette unit; a movable cassette hopper on which a housed recording medium is to be placed; and a locking section that holds the attitude of the cassette hopper. The feeding-apparatus main body includes a contact portion that comes into contact with the locking section to release the holding state when the cassette unit is mounted to the feeding-apparatus main body.

According to the first aspect of the invention, the feeding apparatus has the locking section at the cassette unit. The locking section prevents pattering noise due to the movement of the cassette hopper, with the cassette unit dismounted from the feeding-apparatus main body.

The locking section also prevents the recording surface of the housed recording medium from being damaged by the movement of the cassette hopper.

The locking section also prevents foreign matter, such as dust, from entering the cassette unit through a gap caused by the movement of the cassette hopper.

The feeding apparatus has the contact portion at the feeding-apparatus main body. This allows the holding state to be released using the power that the user pushes the cassette unit when mounting the cassette unit to the feeding-apparatus main body. This offers user convenience because there is no need for the user to directly operate the locking section. The feeding apparatus can thus start the feeding of the recording medium upon completion of the mounting of the cassette unit.

Preferably, the locking section is constructed to swingingly project from the casing of the cassette unit so that the distal free end of the locking section comes into contact with the cassette hopper to hold the attitude of the cassette hopper; and the distal free end of the locking section is thicker than the proximal end of the locking section.

This ensures that the attitude of the cassette hopper is held by the thick free end. In other words, this prevents the possibility of the deformation of the free end of the locking section due external force, ensuring that the attitude of the cassette hopper is held.

Preferably, the proximal end of the locking section is integrated with the casing of the cassette unit with a connecting portion thinner than the distal free end; and the locking section swings in the direction intersecting the direction of the movement of the cassette hopper by the deflection of the connecting portion.

This allows the locking section to easily swing at the thin connecting portion.

When the contact portion comes into contact with the locking section, the connecting portion is elastically deformed and deflected to displace the locking section, thereby releasing the state in which the locking section holds the cassette hopper. When the contact portion separates from the locking section, the connecting portion can be returned to a non-elastically deformed or deflected state. The displacement of the locking section when the connecting portion returns to the non-deflected state allows the locking section to be returned to the state in which the locking section holds the attitude of the cassette hopper. In other words, the elastic deformation of the connecting portion facilitates displacement of the locking section to return the locking section to the holding state or release the holding state.

Preferably, the contact portion includes: a first engaging portion that engages with the locking section to release a state in which the locking section holds the attitude of the cassette hopper when the cassette unit is mounted to the feeding-apparatus main body; and a second engaging portion that engages with the locking section to make the locking section hold the attitude of the cassette hopper when the cassette unit is dismounted from the feeding-apparatus main body.

This allows the locking section to be displaced more reliably to return to the state of holding the attitude of the cassette hopper or release the state of holding the attitude of the cassette hopper. In other words, the second engaging portion forcibly displaces the locking section to return to the state of holding the attitude of the cassette hopper when the cassette unit is dismounted from the feeding-apparatus main body. This is advantageous when the durability of the connecting portion is poor or the elasticity of the connecting portion is poor.

For example, this is particularly advantageous when the durability of the connecting portion is poor, so that the elasticity is decreased with time.

Preferably, the contact portion projects in the direction in which the cassette unit is dismounted; the first engaging portion is a step at the proximal end of the contact portion; and the second engaging portion is a hook at the distal end of the contact portion.

This facilitates forming the first engaging portion and the second engaging portion.

Preferably, when the cassette unit is dismounted from the feeding-apparatus main body, the second engaging portion engages with the locking section and swings the locking section to make the locking section hold the attitude of the cassette hopper; and the swing of the locking section causes a gap between the second engaging portion and the locking section to release the engagement between the second engaging portion and the locking section.

In this case, the second engaging portion forcibly displaces the locking section to return to the state of holding the attitude of the cassette hopper and thereafter the engagement between the second engaging portion and the locking section is released. This eliminates the possibility that the second engaging portion prevents the cassette unit from being dismounted from the feeding-apparatus main body when the cassette unit is dismounted from the recording-apparatus main body. This allows the cassette unit to be smoothly dismounted from the feeding-apparatus main body with a simple structure.

Preferably, the cassette hopper includes an attitude stabilizing portion that can be engaged with the locking section to stabilize the attitude of the locking section while the locking section is holding the attitude of the cassette hopper.

The attitude stabilizing portion engages with the locking section to stabilize the attitude of the locking section, with the locking section holding the attitude of the cassette hopper.

This allows the attitude of the locking section to be stabilized in the state of holding the cassette hopper after the cassette unit is dismounted from the feeding-apparatus main body until the cassette unit is mounted to the feeding-apparatus main body again. In other words, this ensures that the attitude of the cassette hopper is held after the cassette unit is dismounted from the feeding-apparatus main body until the cassette unit is mounted to the feeding-apparatus main body again. In other words, this prevents the locking section from unintentionally releasing the state of holding the attitude of the cassette hopper.

Preferably, the cassette hopper can be moved toward and away from the feed roller of the recording-apparatus main body; and the locking section holds the attitude of the cassette hopper when the cassette hopper is most apart from the feed roller in the moving range.

This prevents the possibility that the cassette hopper pushes the recording medium, with the cassette unit dismounted from the feeding-apparatus main body. This prevents the recording surface of the housed recording medium from being damaged, allowing the recording medium to be protected more effectively.

Preferably, the locking section has urging force in the direction of approaching the cassette hopper; and when the contact portion comes into contact with the locking section, the locking section separates from the cassette hopper; and when the contact portion separates from the locking section, the locking section comes into contact with the cassette hopper.

This allows the locking section to be switched to the state of holding the cassette hopper when the cassette unit is dismounted from the feeding-apparatus main body. This offers user convenience because there is no need for the user to directly operate the locking section.

Preferably, the locking section is elastically deformed together with the casing of the cassette unit.

This facilitates forming the locking section, and generating the urging force. This eliminates the need for providing additional urging means. This is advantageous in cost.

Preferably, the direction in which the locking section is displaced intersects the direction in which the cassette hopper moves; and the casing has an attitude stabilizing portion, at a position adjacent to the feed roller with respect to the locking section, for preventing the displacement of the locking section in the direction of the movement of the cassette hopper.

This allows the attitude holding section to prevent the deformation of the locking section in the direction of approaching the feed roller. This allows the locking section to hold the cassette hopper with high accuracy.

Preferably, the locked-attitude holding portion is the inner surface of the cassette front surface, which is the surface of the cassette casing adjacent to the feed roller; and the locking section can come into contact with the inner surface.

This allows the locking section to hold the cassette hopper with higher accuracy.

Preferably, the recording apparatus includes a feeding section for feeding a recording medium placed thereon and a recording section for recording the recording medium fed from the feeding section with a recording head; and the feeding section includes the above-described feeding apparatus.

Thus the recording apparatus has the advantages described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the drawings.

Figure 1:
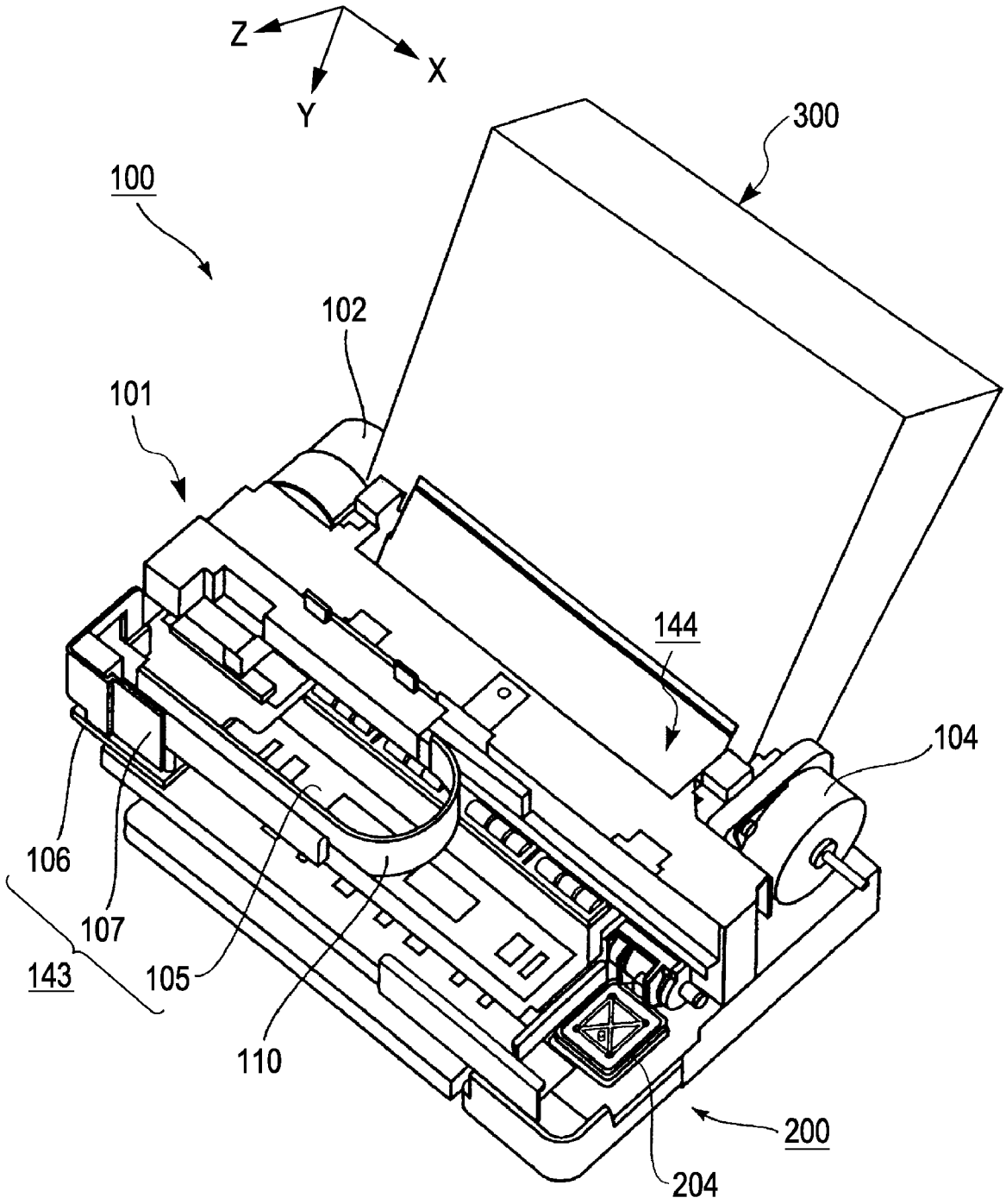
FIG. 1 is a schematic general perspective view of a recording apparatus according to a first embodiment of the invention.
Figure 2:
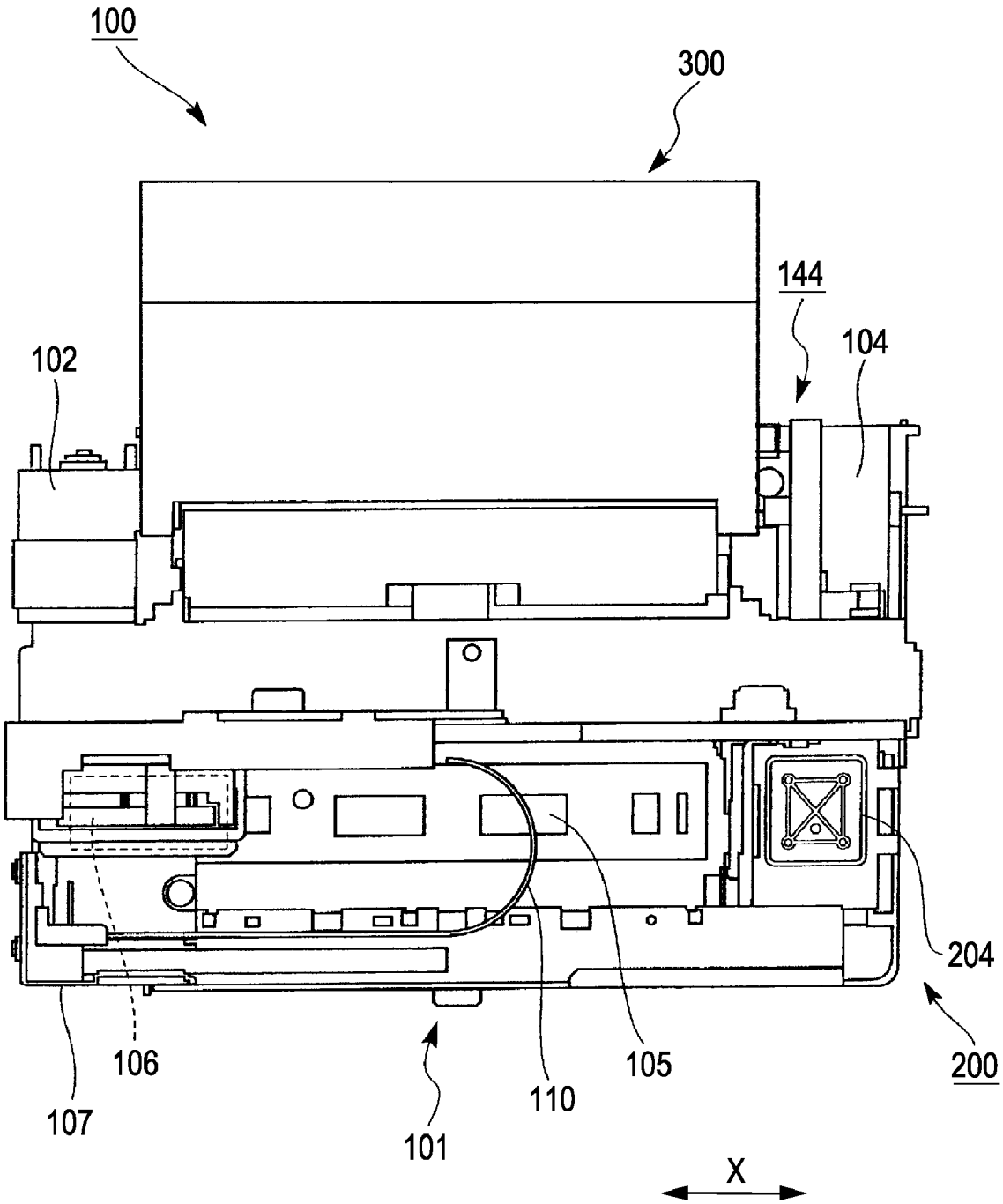
FIG. 2 is a schematic general plan view of the recording apparatus according to the first embodiment.

FIG. 1 is a schematic general perspective view of a recording apparatus, denoted by numeral 100, which is an example of a liquid ejecting apparatus according to a first embodiment of the invention. FIG. 2 is a schematic general plan view of the recording apparatus 100.

The liquid ejecting apparatus herein is not limited to recording apparatuses, such as an ink-jet recording apparatus, a copying machine, and a facsimile machine, which eject ink onto a recording medium, such as recording paper, from a recording head, or a liquid ejecting head, to record onto the recording material, but include apparatuses that eject liquid for specific use, instead of ink, onto a material corresponding to the recording medium from a liquid ejecting head corresponding to a recording head to apply the liquid onto the material.

Examples of the liquid ejecting head include, in addition to the recording head, a color-material ejecting head for use in manufacturing color filters of, for example, a liquid-crystal display, an electrode-material (conductive-paste) ejecting head for use in forming electrodes of, for example, organic EL displays and field-emission displays (FEDs), a bioorganic-material ejecting head for use in manufacturing biochips, and a sample ejecting head, such as a precision pipette, for ejecting a sample.

The recording apparatus 100 includes a feeding section 144 having a cassette unit 300 on the back of the main body 101. A stack of paper P, which is a recording medium, is placed in the cassette unit 300. The cassette unit 300 has therein a cassette hopper 302 (see FIG. 3, FIGS. 5 to 12, and FIGS. 15 to 20) in such a manner as to be moved toward and away from a feed roller 190, to be described later (see FIGS. 3 and 4), of the feeding section 144. Specifically, the cassette hopper 302 extends in the direction X of the width of the paper P, and swings about a first connecting portion 303 (see FIG. 3) at the top of the cassette hopper 302.

The uppermost paper P on the cassette hopper 302 (see FIG. 3, FIGS. 5 to 12, and FIGS. 15 to 20) is fed to a recording section 143 downstream in the feeding direction by the feeding section 144. Specifically, the placed paper P is sent to a downstream transport roller pair (not shown) by the feed roller 190 driven by a feed motor 104 while being guided by right and left edge guides 312 (see FIG. 6). The paper P sent to the transport roller pair is sent to the downstream recording section 143 by the transport roller pair driven by a transport motor (not shown).

The recording section 143 includes a platen 105 that supports the paper P from below and a carriage 107 provided above the platen 105 so as to be opposed to the platen 105. The carriage 107 is driven by a carriage motor 102 while being guided by a carriage guide shaft (not shown) extending in the main scanning direction which is the direction X of the width of the paper P transported. The bottom of the carriage 107 has a recording head 106 that ejects ink onto the paper P. The paper P recorded by the recording section 143 is further transported downstream, and ejected from the front of the recording apparatus 100 by an expelling roller (not shown).

The recording apparatus 100 has an ink cartridge (not shown) at the lower part of the main body 101, from which ink is supplied to an ink supply channel (not shown) through an ink supply needle (not shown). The ink is sent to the recording head 106 of the carriage 107 through an ink feed tube 110. The recording-apparatus main body 101 further has an ink suction device 200 at the first column, or the right in FIG. 1. The ink suction device 200 serves as an ejection-characteristic maintaining section for maintaining the ejection characteristic of the recording section 143. The ink suction device 200 ejects and sucks ink. The ink suction device 200 has a cap 204 so as to seal the recording head 106 by moving the cap 204 up and down.

Figure 3:
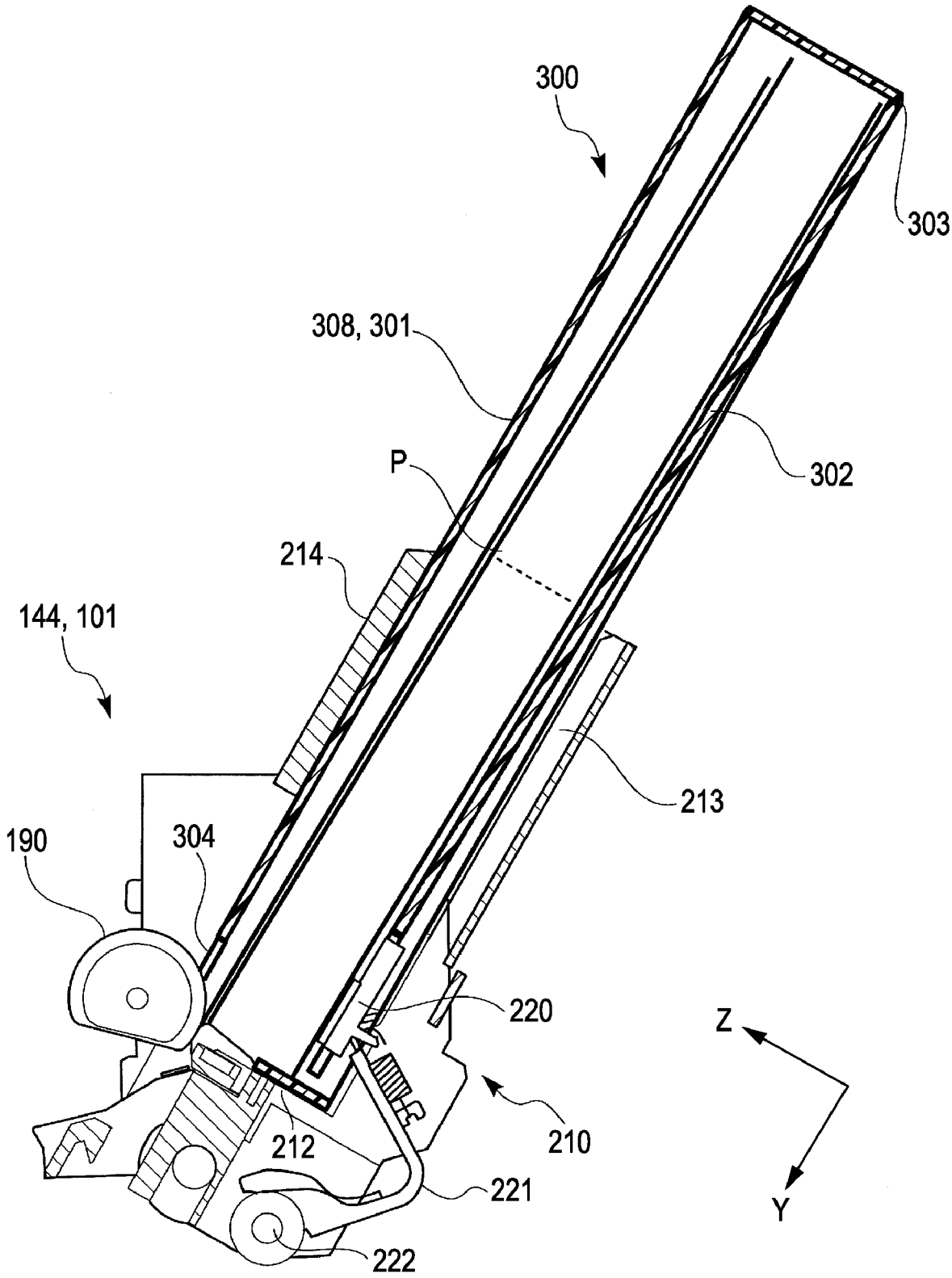
FIG. 3 is a general side sectional view of a feeding section, with a hopper up (the maximum number).

FIG. 3 is a general side sectional view of the feeding section 144 in which the maximum number of paper P is placed, with a hopper 202 up.

The maximum number indicates the maximum number of paper A to be housed in the cassette unit 300.

As shown in FIG. 3, the feeding section 144 includes the cassette unit 300, the feed roller 190, the hopper 202, and a base member 210. The cassette unit 300 includes a cassette casing 301 and the cassette hopper 302. The cassette casing 301 serves as a cover case for covering the housed paper P. The cassette hopper 302 is connected to the cassette casing 301 with the first connecting portion 303 such that the lower part swings about the first connecting portion 303 relative to the feed roller 190.

The base member 210 includes a cassette guide 213, a cassette holder 214, and a pair of holding portions 212 in the direction of the X-axis. The cassette guide 213 guides the distal end of the cassette unit 300 when the cassette unit 300 is mounted. The cassette guide 213 prevents the cassette unit 300 from moving apart from the feed roller 190 in the Z-direction, which is the direction of the thickness of the paper P.

The cassette holder 214 holds the attitude of the mounted cassette unit 300 in cooperation with the cassette guide 213. The pair of holding portions 212 holds the position of the mounted cassette unit 300 in the Y-direction which is the mounting direction. Specifically, the pair of holding portions 212 is to come into contact with a pair of positioning protrusions 310 (see FIGS. 7 to 9) provided along the X-axis at the distal end of the cassette unit 300 in the mounting direction.

The base member 210 has a hopper lever 221 swingingly about a lever shaft 222. The hopper 220 is mounted at the distal end of the hopper lever 221 so as to change in attitude.

The hopper lever 221 is urged counterclockwise in the drawing by a hopper spring (not shown). A cam mechanism (not shown) that is rotated by the power of the feed motor 104 rotates the hopper lever 221 clockwise against the urging force of the hopper spring.

The hopper 220 can thus be moved toward and away from the feed roller 190. Specifically, when the cam mechanism is disengaged, the hopper 220 comes close to the feed roller 190 into a hopper-up state. When the cam mechanism engages, the hopper 220 comes apart from the feed roller 190 into a hopper-down state.

The cassette front surface 308 of the cassette casing 301 has a feed opening 304 at a position opposed to the feed roller 190. With the hopper 220 up, the uppermost paper P therefore comes into contact with the feed roller 190. The power of the feed motor 104 is sent to the feed roller 190 via a gear train 215 (see FIG. 4) and a well-known clutch unit 216 (see FIG. 4). Accordingly, when the feed roller 190 rotates clockwise in FIG. 3, the uppermost paper P is fed downstream in the feeding direction.

The clutch unit 216 is constructed to break power transmission to stop the feed roller 190 when the feed roller 190 rotates one turn.

Figure 4:
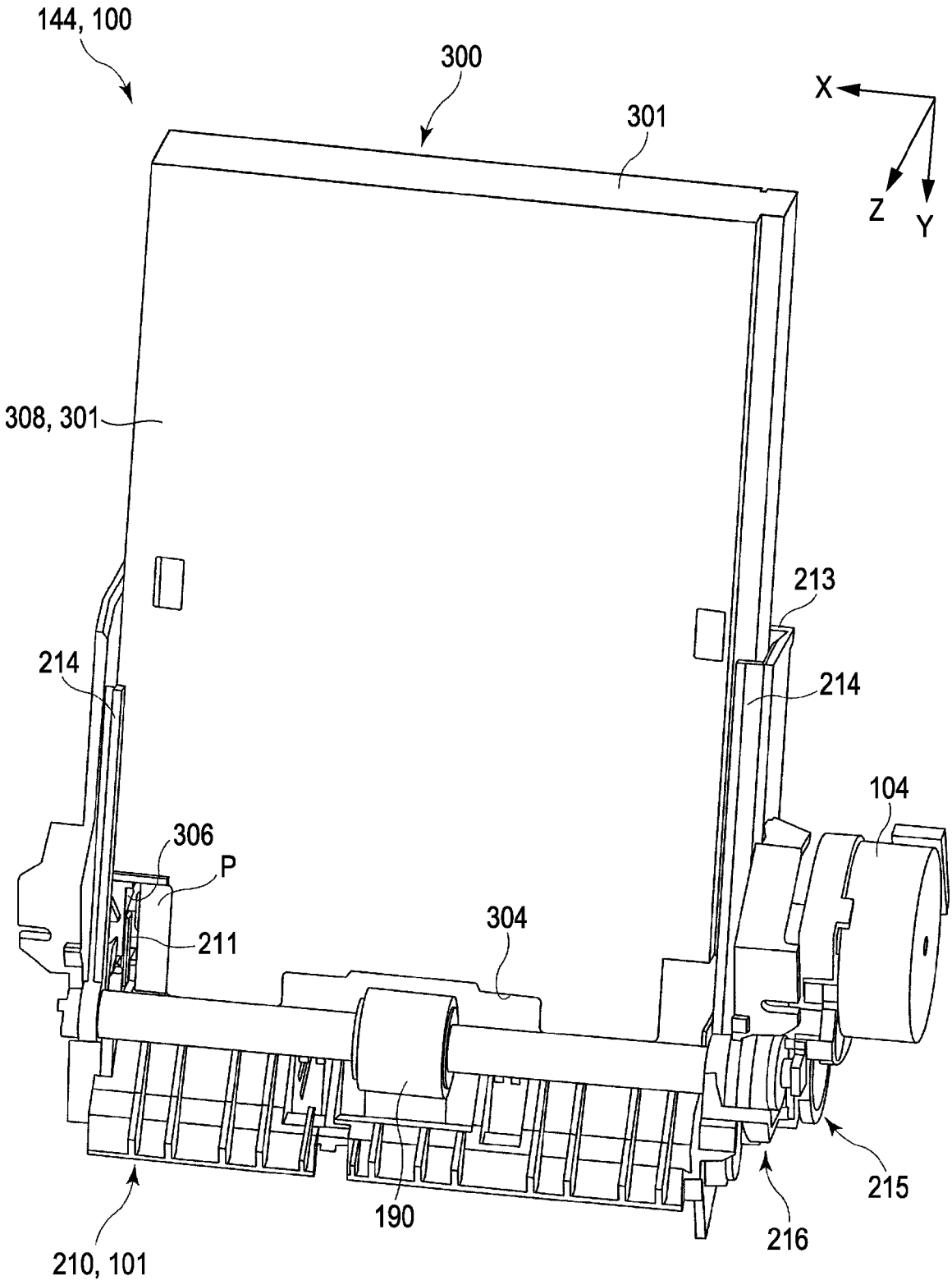
FIG. 4 is a general perspective view of the feeding section (with the cassette unit mounted).
Figure 5:
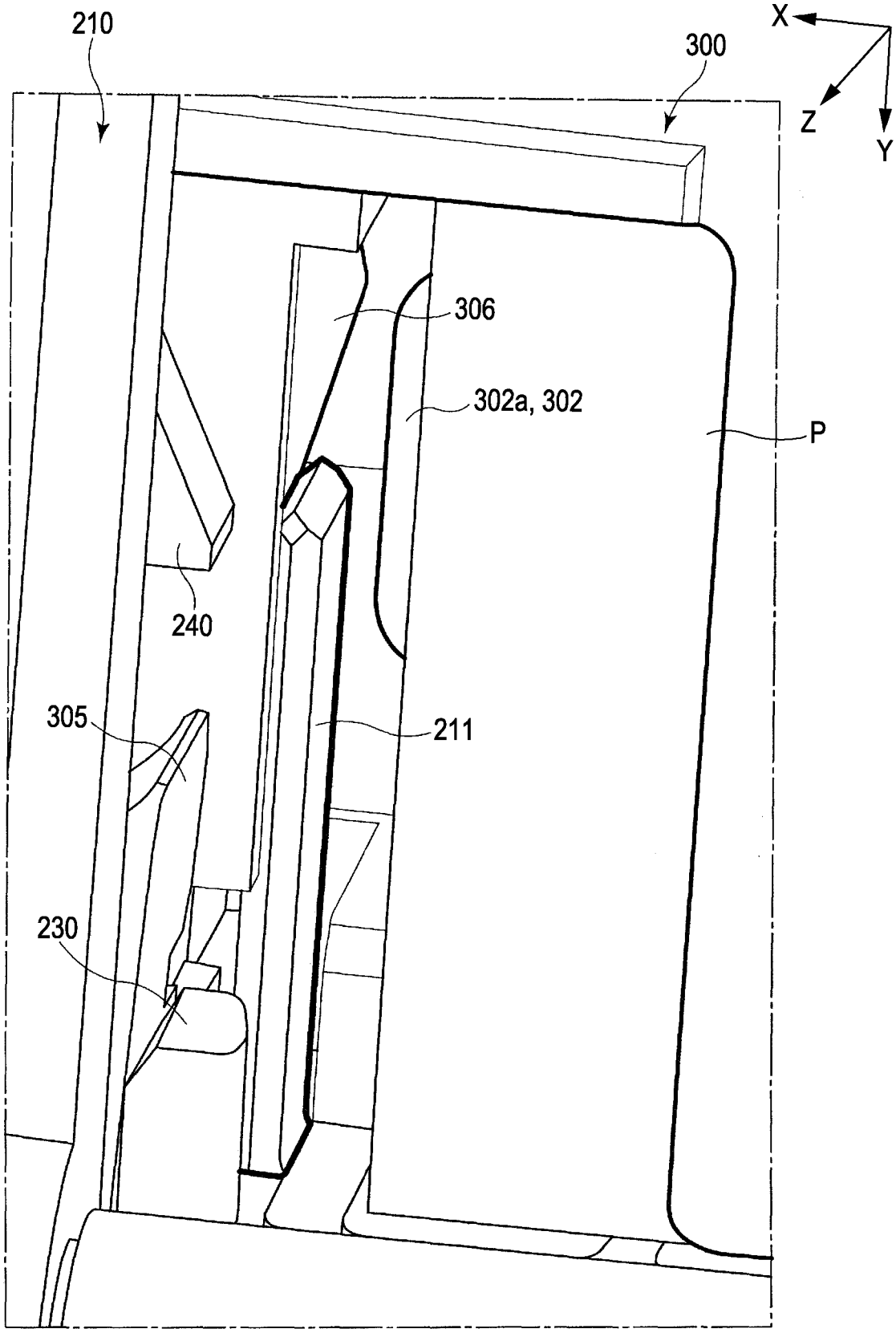
FIG. 5 is an enlarged perspective view of essential parts adjacent to the $80^{th}$ column in FIG. 4 (with the cassette unit mounted).

FIG. 4 is a general perspective view of the feeding section 144, with the cassette unit 300 mounted. FIG. 5 is an enlarged perspective view of essential parts adjacent to the widthwise $80^{th}$ column in FIG. 4. The $80^{th}$ column indicates the left in the direction of the X-axis in FIG. 4.

Figure 6:
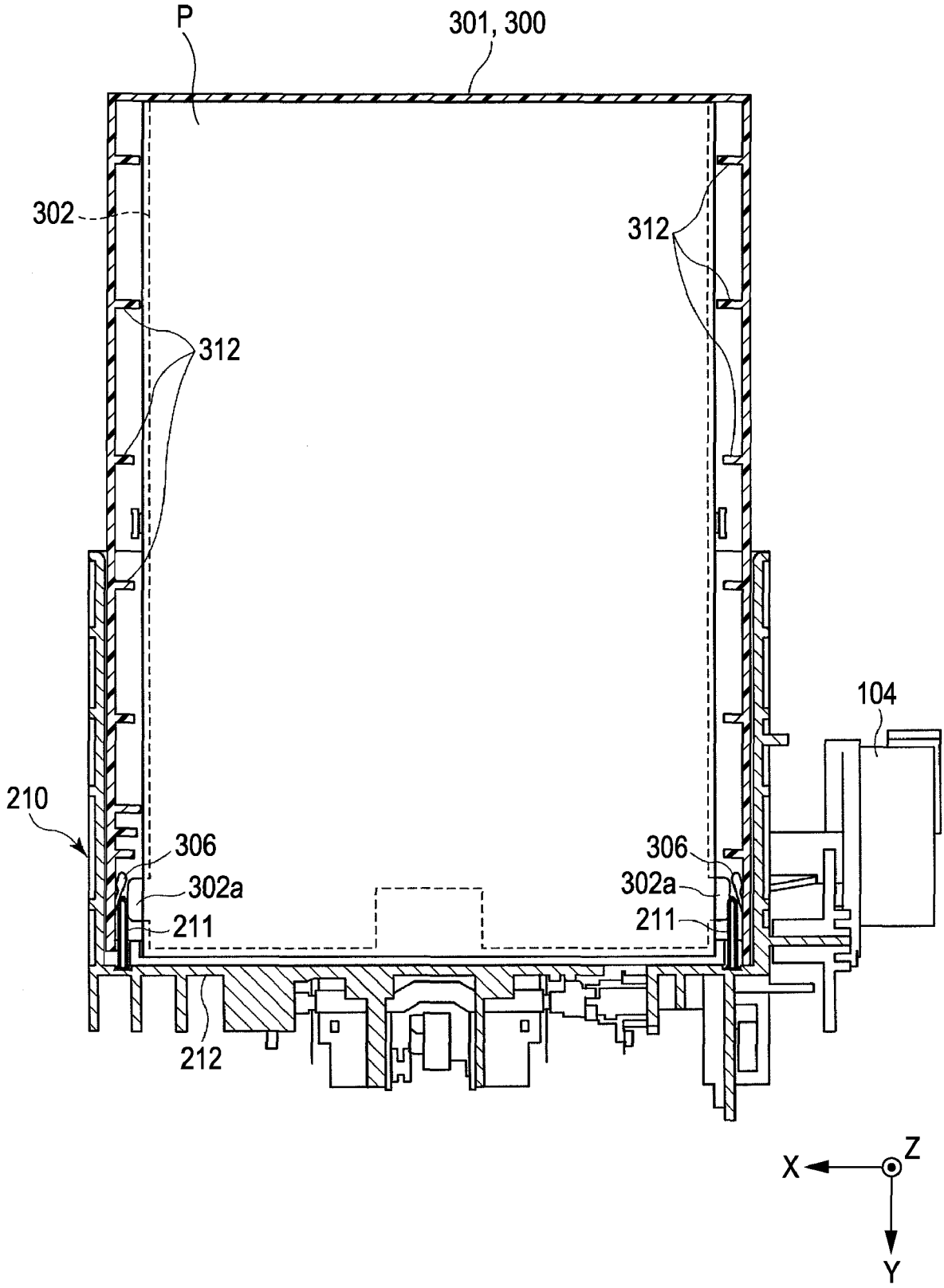
FIG. 6 is a front sectional view of FIG. 4 (with the cassette unit mounted).
Figure 7:
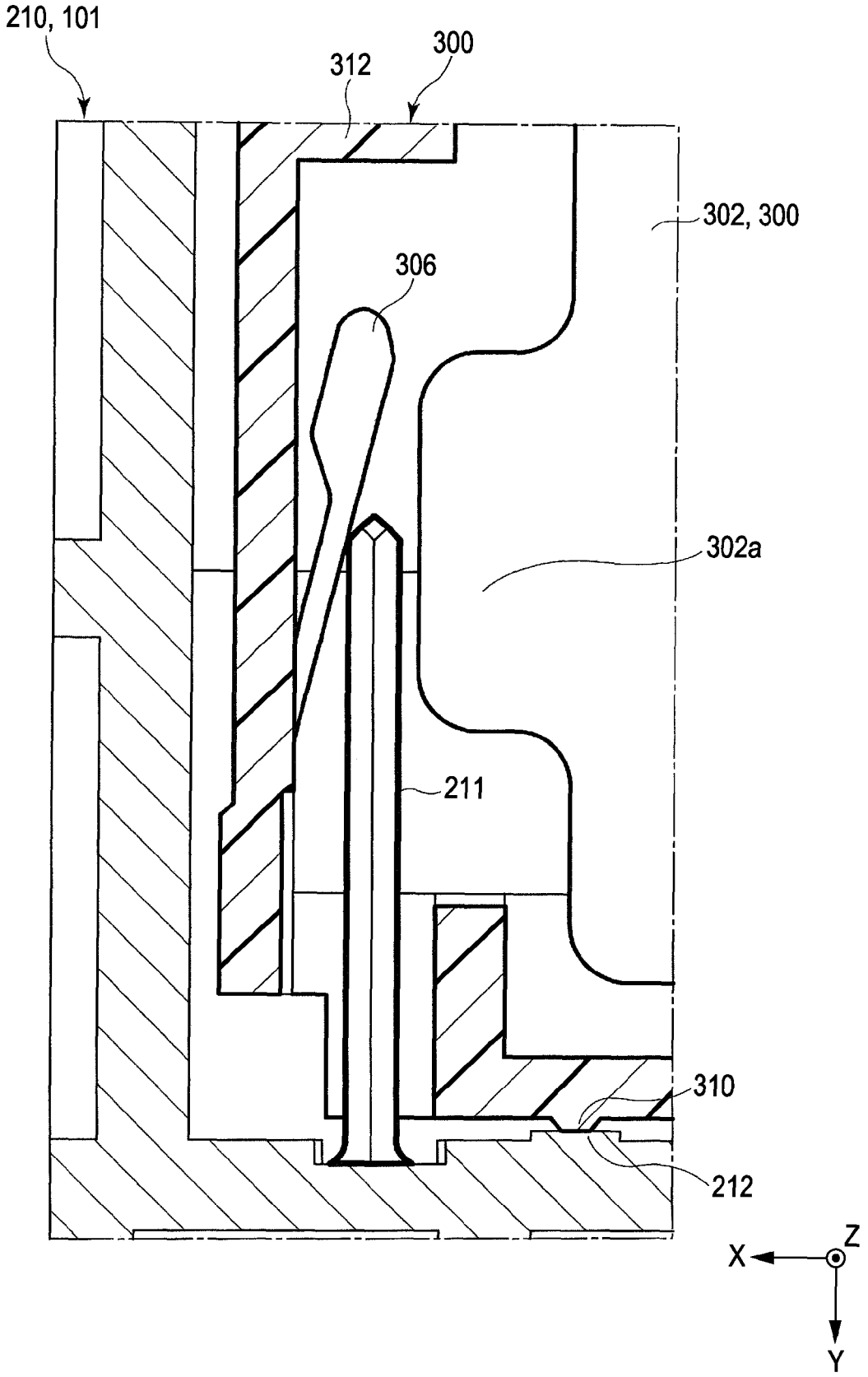
FIG. 7 is an enlarged front sectional view of the essential parts adjacent to the $80^{th}$ column of FIG. 6 (with the cassette unit mounted).

FIG. 6 is a front sectional view of FIG. 4. FIG. 7 is an enlarged front sectional view of the essential parts adjacent to the $80^{th}$ column of FIG. 6.

As shown in FIGS. 4 to 7, the base member 210 has a pair of projections 211 in the width direction X (particularly see FIG. 6).

The cassette unit 300 has a pair of locking sections 306 in the width direction X. The locking sections 306 are integrated with the cassette casing 301 so as to be elastically deformed. The locking sections 306 can be engaged with a pair of tabs 302*a* provided on either side of the cassette hopper 302 in the width direction X.

The details of the action of the locking sections 306 will be described later.

The projections 211 can be brought into contact with the locking sections 306. With the cassette unit 300 mounted to the recording-apparatus main body 101, the projections 211 elastically deform the locking sections 306 to the outside in the width direction X.

The outside indicates the $80^{th}$ column and the first column, with the cassette hopper 302 in between.

The locking sections 306 are thus separated from the tabs 302*a*.

The base member 210 has a shutter opening protrusion 230 so as to open a shutter 305 on the cassette unit 300 when the cassette unit 300 is mounted. The base member 210 further has a shutter closing hook 240 so as to close the shutter 305 in an open state when the cassette unit 300 is dismounted.

The shutter 305 is a member for preventing or allowing the movement of the paper P housed in the cassette unit 300 to the outside of the cassette unit 300 through the feed opening 304 by a closing or opening operation. Specifically, the shutter 305 is integrated with the cassette casing 301 with a third connecting portion 305*a* (see FIG. 21). The third connecting portion 305*a* is the thinnest on the shutter 305. This allows the shutter 305 to rotate about the third connecting portion 305*a*.

Locked State of Cassette Hopper

Figure 8:
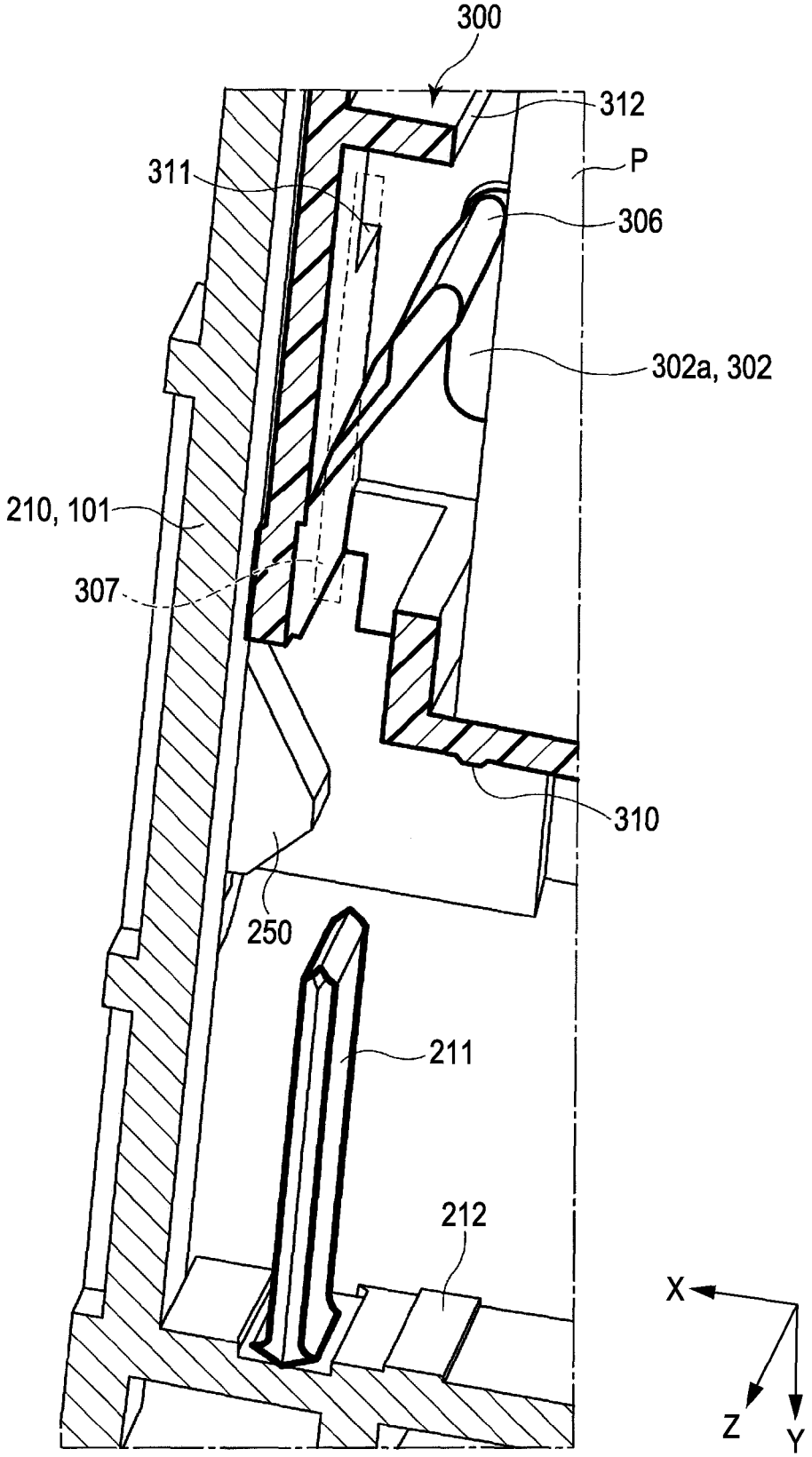
FIG. 8 is an enlarged perspective view of the essential parts adjacent to the $80^{th}$ column, showing the mounting of the cassette unit.
Figure 9:
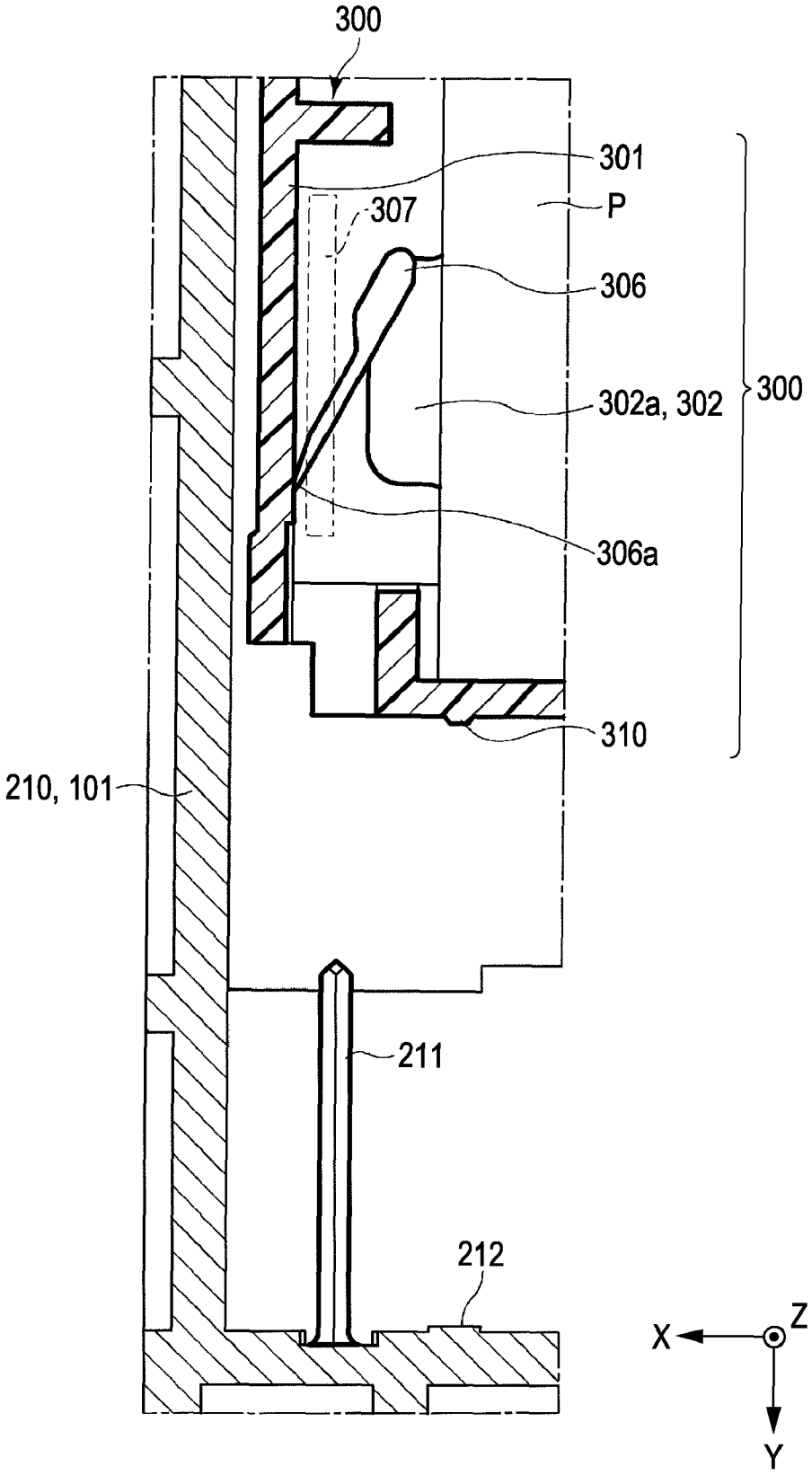
FIG. 9 is an enlarged front sectional view of FIG. 8.

FIG. 8 is an enlarged perspective view of essential parts adjacent to the $80^{th}$ column, showing the mounting of the cassette unit 300. FIG. 9 is an enlarged front sectional view of FIG. 8.

Figure 10:
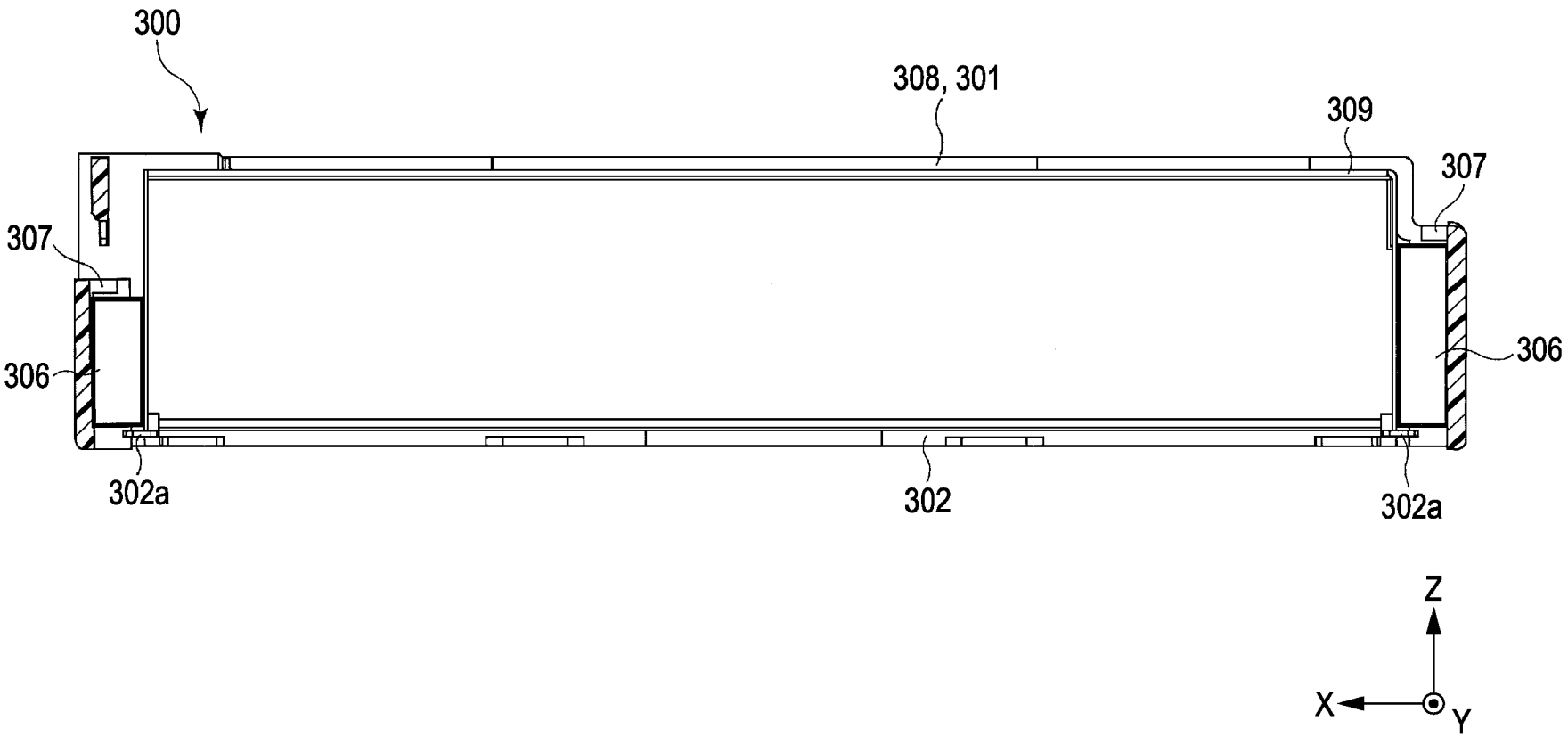
FIG. 10 is a sectional view of the cassette unit, with the cassette hopper locked.
Figure 11:
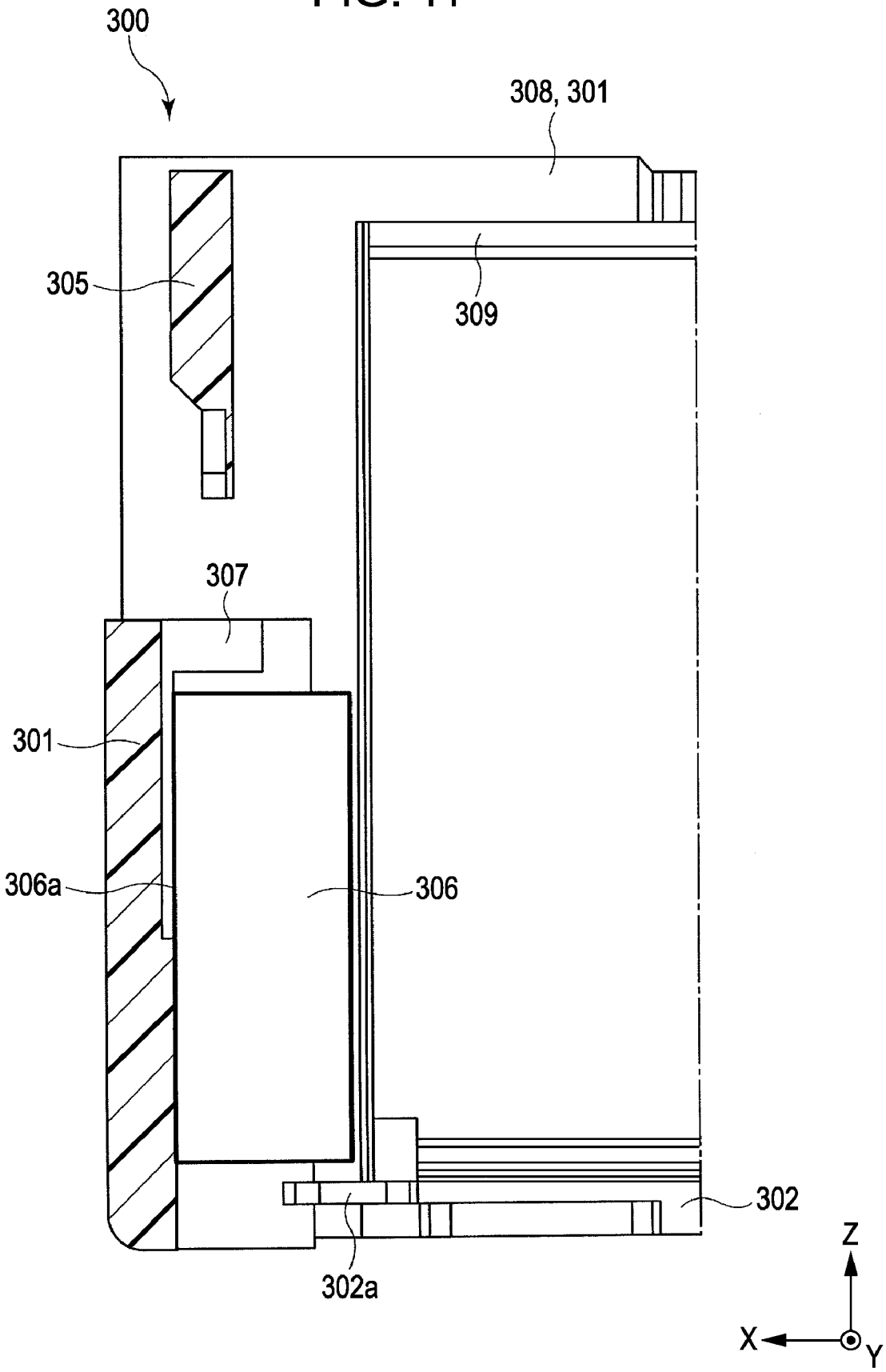
FIG. 11 is an enlarged sectional view of the essential parts adjacent to the widthwise $80^{th}$ column in FIG. 10.
Figure 12:
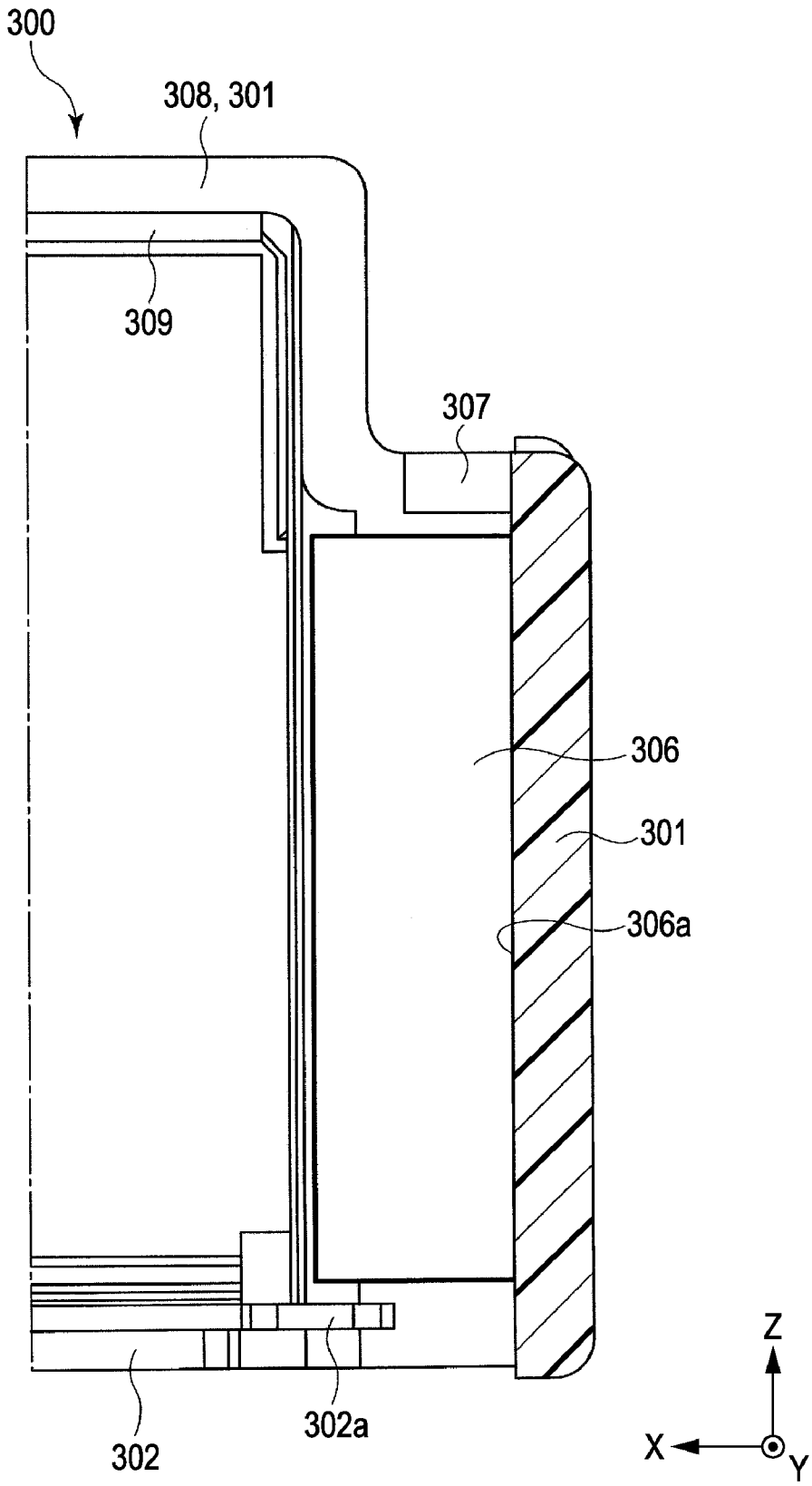
FIG. 12 is an enlarged sectional view of the essential parts adjacent to the widthwise first column in FIG. 10.

FIG. 10 is a sectional view of the cassette unit 300, with the cassette hopper 302 locked. FIG. 11 is an enlarged sectional view of the essential parts adjacent to the widthwise $80^{th}$ column in FIG. 10. FIG. 12 is an enlarged sectional view of the essential parts adjacent to the widthwise first column in FIG. 10.

The first column indicates the side opposite to the $80^{th}$ column in the width direction.

As shown in FIGS. 8 to 12, in the state immediately before the cassette unit 300 is mounted to the recording-apparatus main body 101 and the state in which the cassette unit 300 is dismounted from the recording-apparatus main body 101, the pair of locking sections 306 of the cassette unit 300 is separate from the pair of projections 211 of the base member 210. In other words, the locking sections 306 are not acted by the projections 211. Thus the locking sections 306 are not elastically deformed. Specifically, there is no elastic deformation at second connecting portions 306*a* that connect the locking sections 306 and the cassette casing 301.

The second connecting portions 306*a* are thinnest at the locking sections 306.

At that time, the distal ends of the locking sections 306 agree with the tabs 302*a* of the cassette hopper 302 in the width direction X. This allows the locking sections 306 to prevent the cassette hopper 302 in a fully released state from moving toward the cassette front surface 308. In a word, the locking sections 306 can hold the attitude of the cassette hopper 302 in the fully released state.

The fully released state indicates that the cassette hopper 302 is separated most from the cassette front surface 308 or the feed roller 190 in the range in which the cassette hopper 302 can move.

This eliminates the possibility of causing pattering noise due to the movement of the cassette hopper 302 in the cassette unit 300 dismounted from the recording-apparatus main body 101.

This also eliminates the possibility of damages on the recording surface of the paper P due to the movement of the cassette hopper 302.

The base member 210 has a pair of positioning hooks 250 (see FIG. 8). The positioning hooks 250 engage with a pair of recesses 311 of the cassette unit 300 when the mounting of the cassette unit 300 is complete (see FIG. 13). The positioning hooks 250 are provided on either side in the width direction X, and can be retracted outward in the width direction X by deflection. The positioning hooks 250 each have a slope that inclined in the mounting direction Y.

The positioning hooks 250 urge the cassette unit 300 downstream in the mounting direction with the slopes which come into contact with the recesses 311. Thus the positioning protrusions 310 arranged in the width direction X can be brought into contact with the holding portions 212 arranged in the width direction X. This allows accurate positioning of the cassette unit 300.

The cassette casing 301 has a pair of locked-attitude holding portions 307 at the positions adjacent to the cassette front surface 308 with respect to the locking sections 306. This eliminates the possibility that the locking sections 306 are deformed toward the cassette front surface 308 in the Z-direction even if the user pushes the cassette hopper 302 toward the cassette front surface 308 when taking the cassette unit 300. This ensures that the locking sections 306 hold the attitude of the cassette hopper 302 in its fully released state.

The locked-attitude holding portions 307 may of course be provided on the inner surface 309 of the cassette front surface 308 so that the locking sections 306 are correspondingly increased in length along the Z-axis. This reduces the elastic deformation of the locking sections 306 along the Z-axis. This further ensures that the attitude of the cassette hopper 302 in its fully released state is held.

In this embodiment, the components of the cassette unit 300 are integrally formed of a flexible material. This further reduces the deformation of the locking sections 306 along the Z-axis owing to the elongated locking sections 306 along the Z-axis. This allows the attitude of the cassette hopper 302 along the Z-axis can be held more accurately.

Unlocked State of Cassette Hopper

Figure 13:
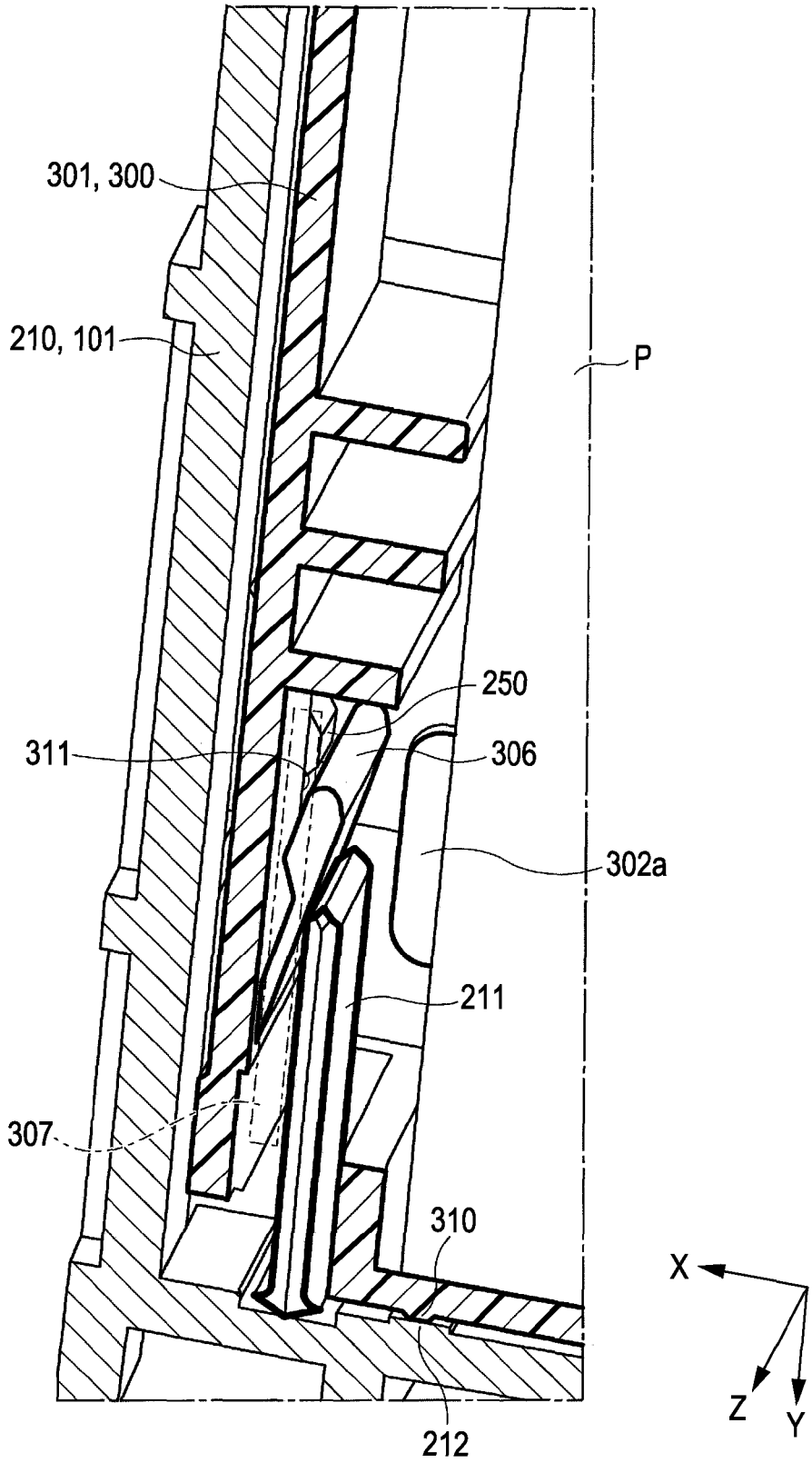
FIG. 13 is an enlarged perspective view of the essential parts adjacent to the $80^{th}$ column, showing a state in which the mounting of the cassette unit is complete.
Figure 14:
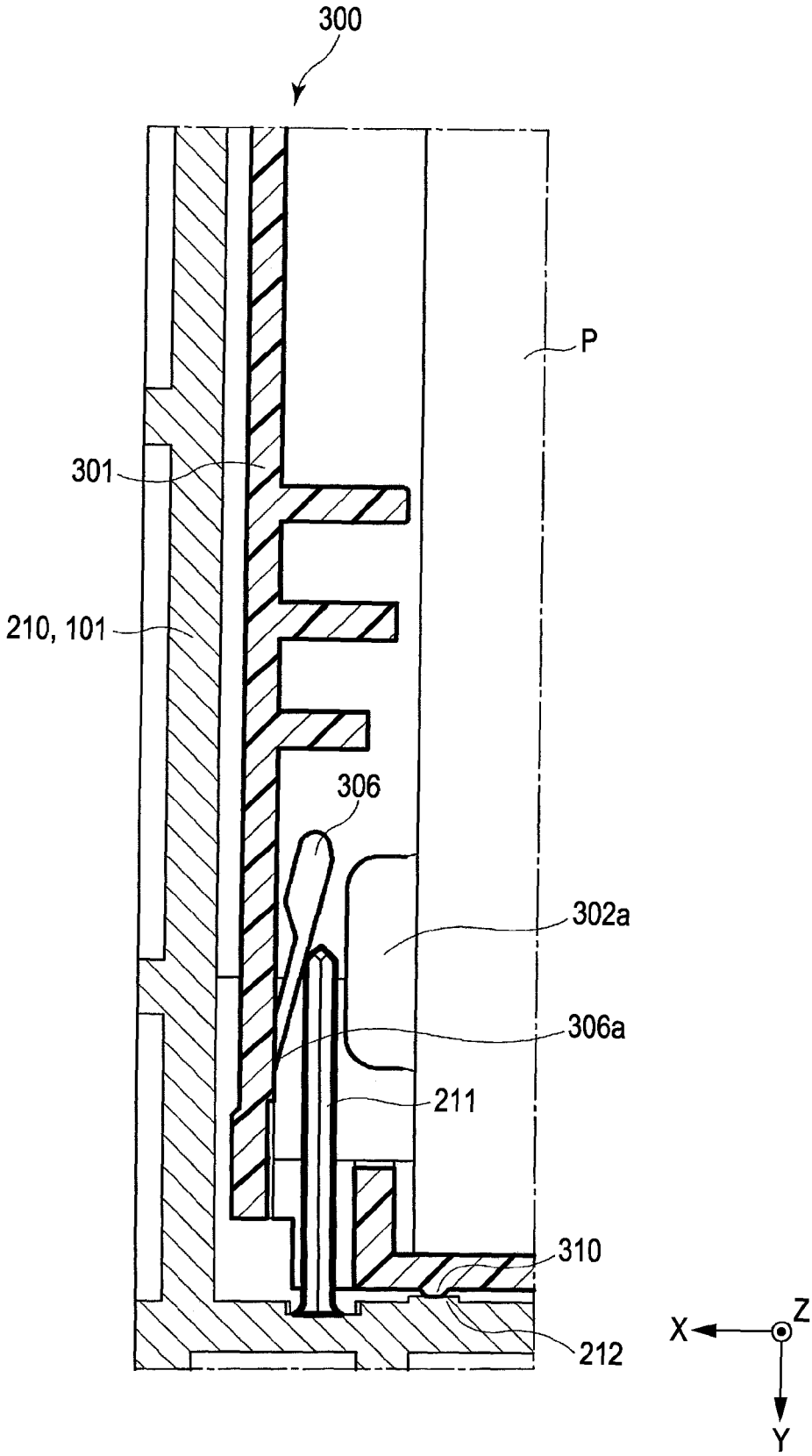
FIG. 14 is an enlarged front sectional view of FIG. 13.

FIG. 13 is an enlarged perspective view of the essential parts adjacent to the widthwise $80^{th}$ column, showing a state in which the mounting of the cassette unit 300 is complete. FIG. 14 is an enlarged front sectional view of FIG. 13.

Figure 15:
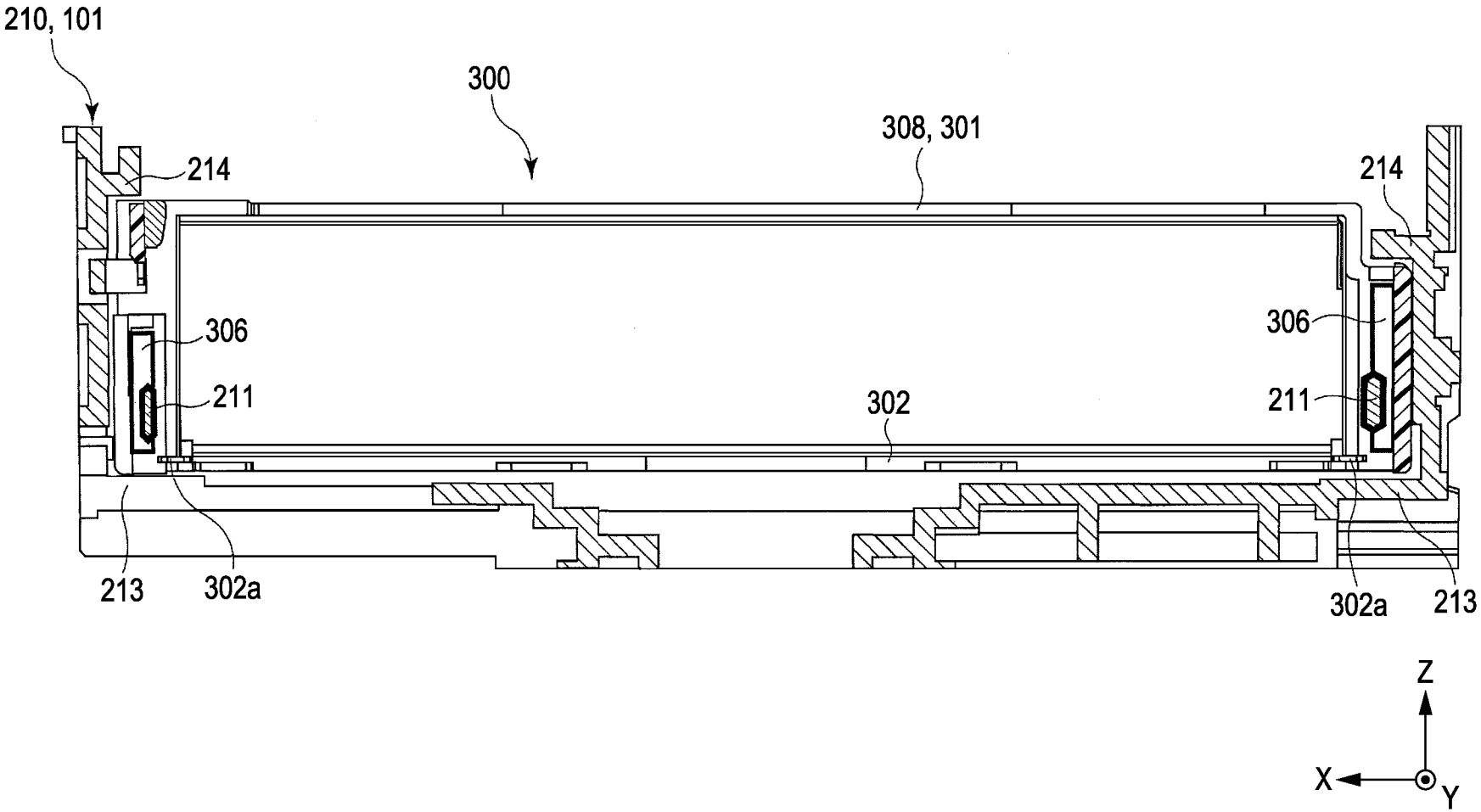
FIG. 15 is a sectional bottom view of the cassette unit, showing the state in which the mounting of the cassette unit is complete.
Figure 16:
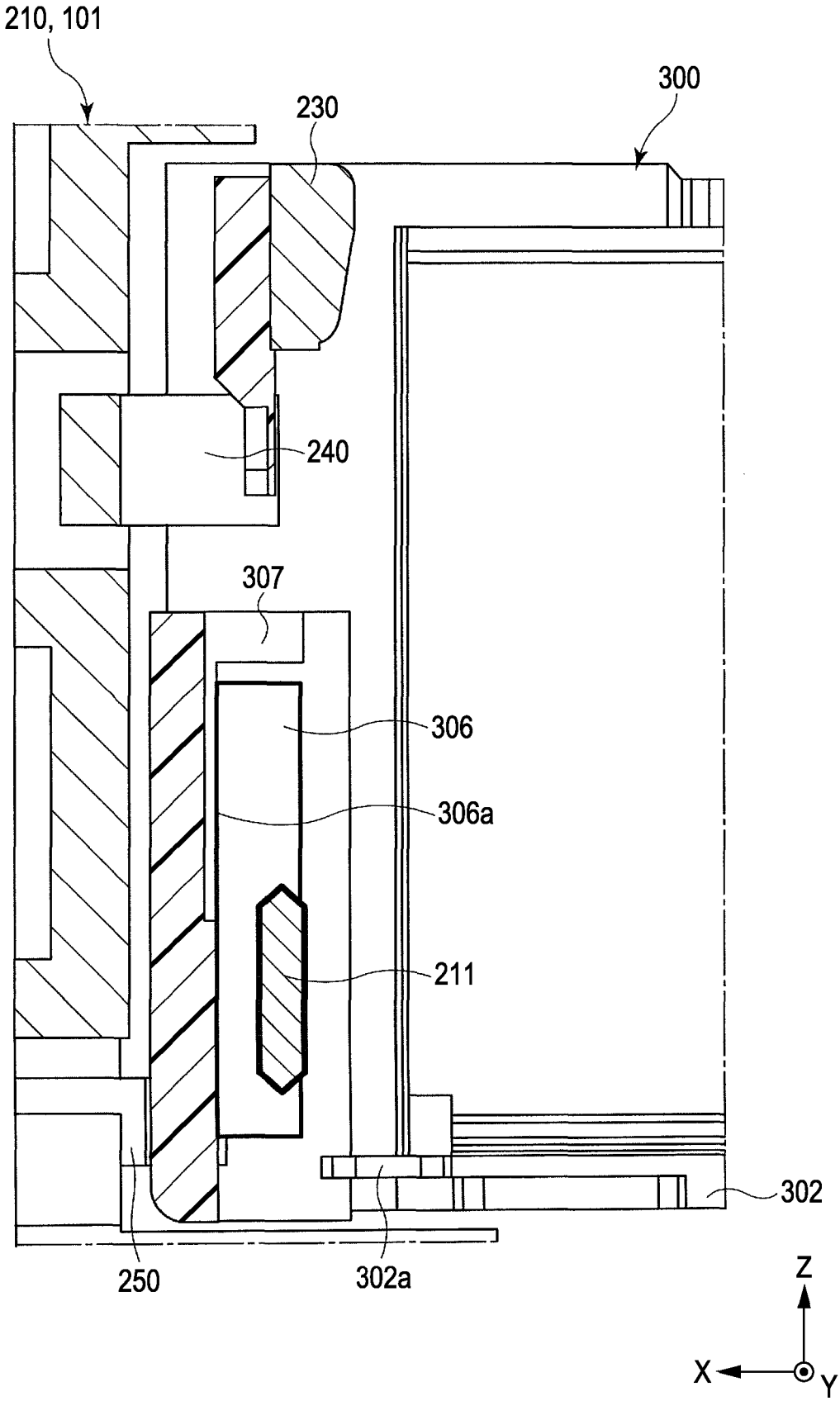
FIG. 16 is an enlarged sectional view of the essential parts adjacent to the $80^{th}$ column in FIG. 15.

FIG. 15 is a sectional bottom view of the cassette unit 300, showing the state in which the mounting of the cassette unit 300 is complete. FIG. 16 is an enlarged sectional view of the essential parts adjacent to the widthwise $80^{th}$ column in FIG. 15.

Figure 17:
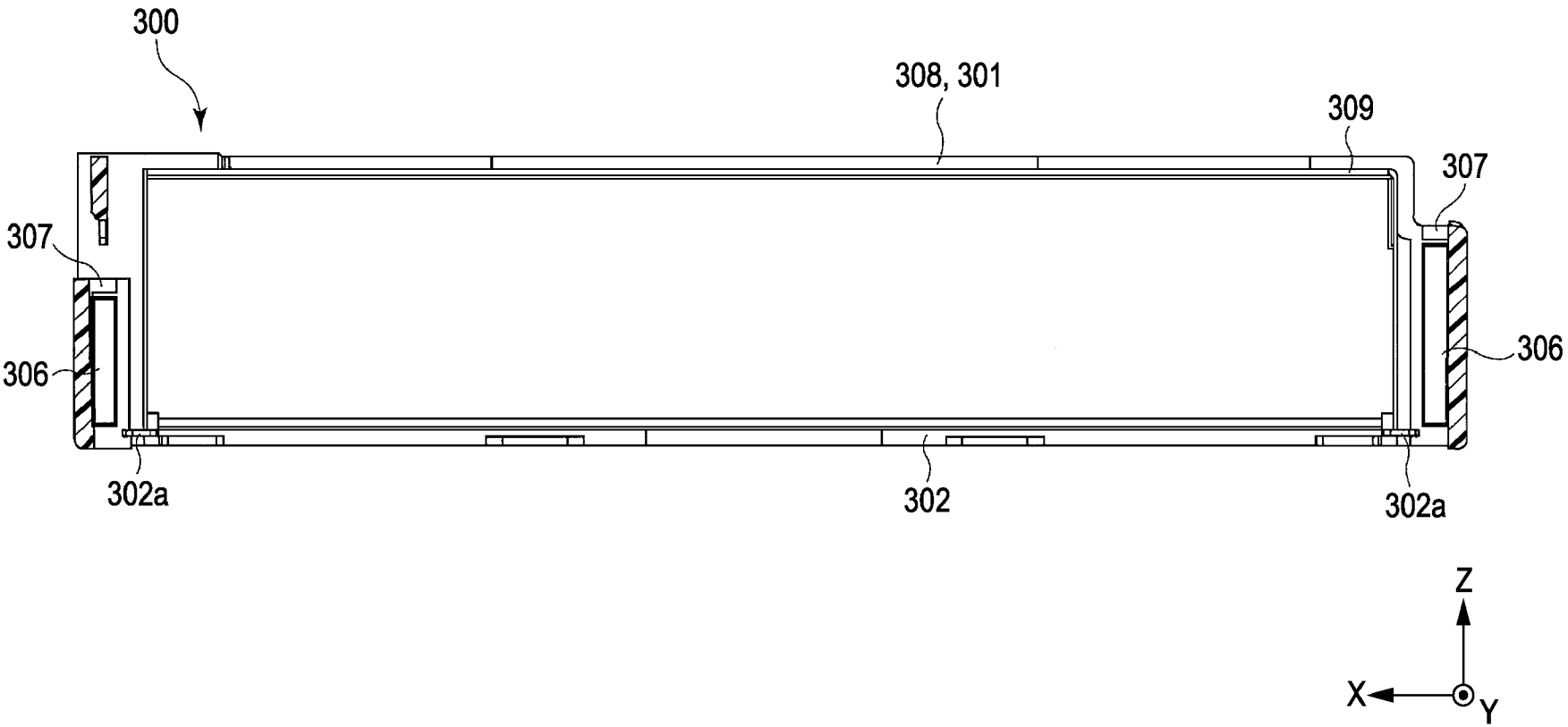
FIG. 17 is a sectional view of the cassette unit, showing a state in which the cassette hopper is unlocked.
Figure 18:
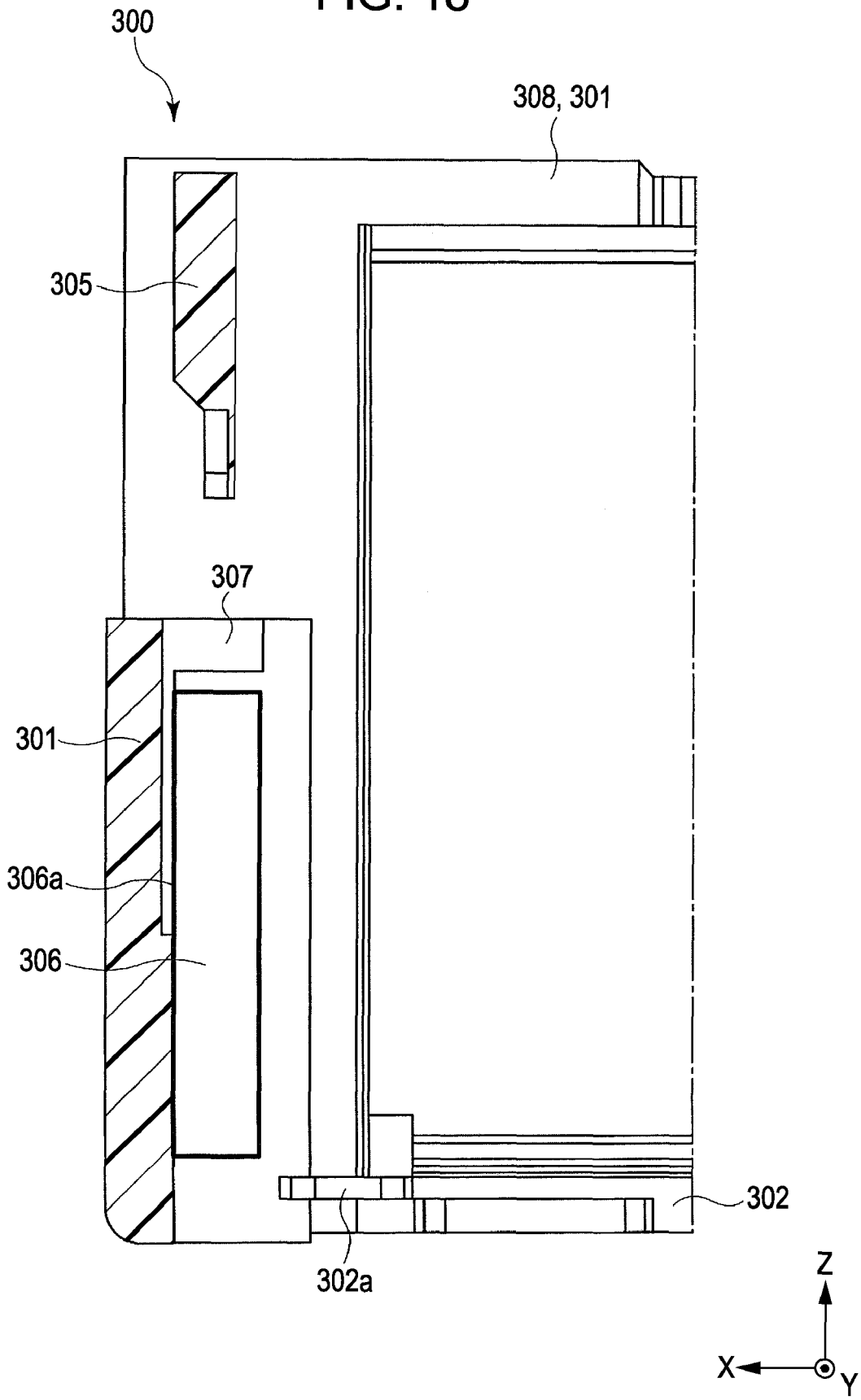
FIG. 18 is an enlarged sectional view of the essential parts adjacent to the $80^{th}$ column in FIG. 17.

FIG. 17 is a sectional view of the cassette unit 300, showing a state in which the cassette hopper 302 is unlocked. FIG. 18 is an enlarged sectional view of the essential parts adjacent to the widthwise $80^{th}$ column in FIG. 17.

Figure 19:
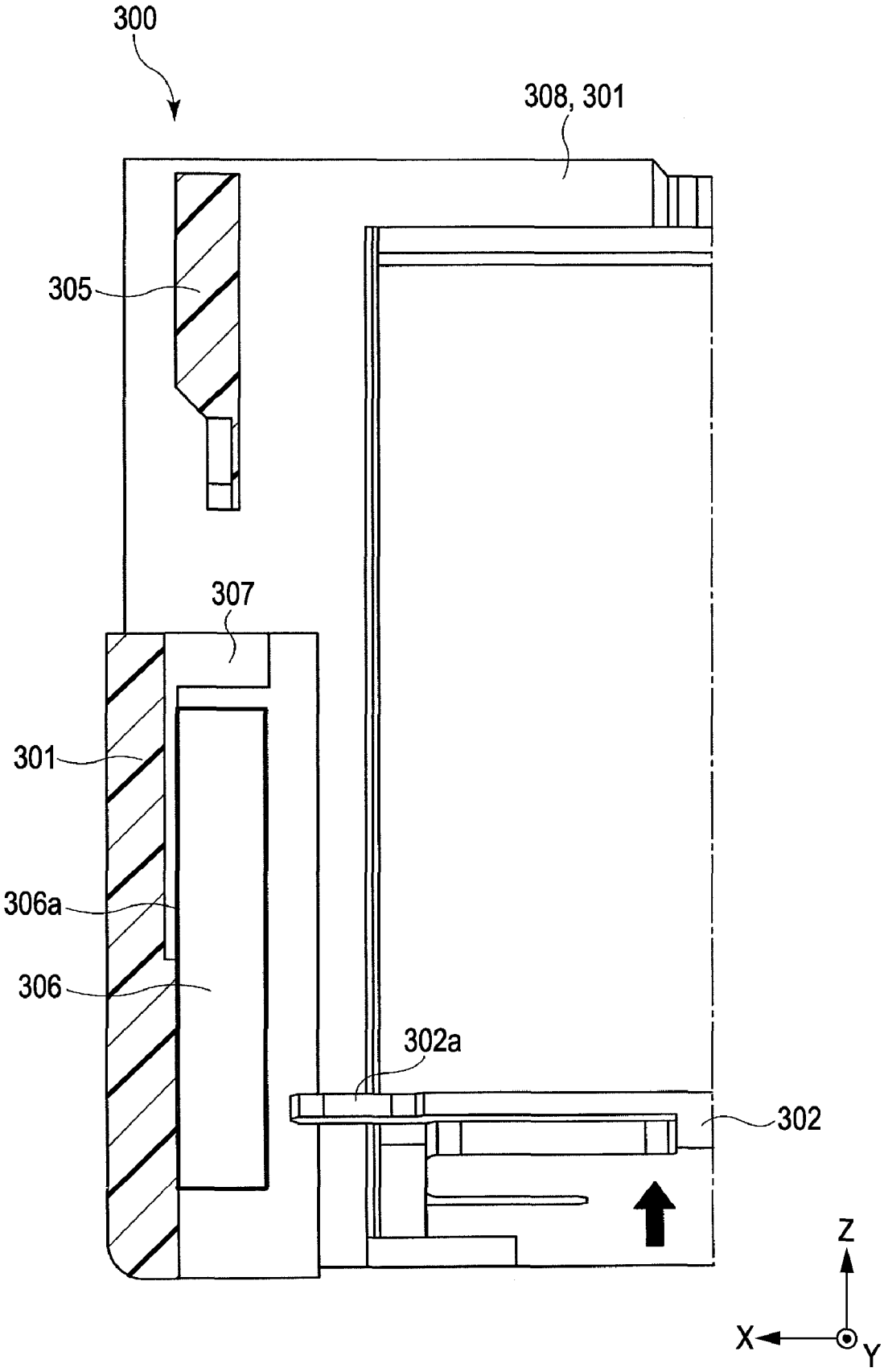
FIG. 19 is an enlarged sectional view of the cassette unit, showing a state in which the cassette hopper hops up from the state of FIG. 18.
Figure 20:
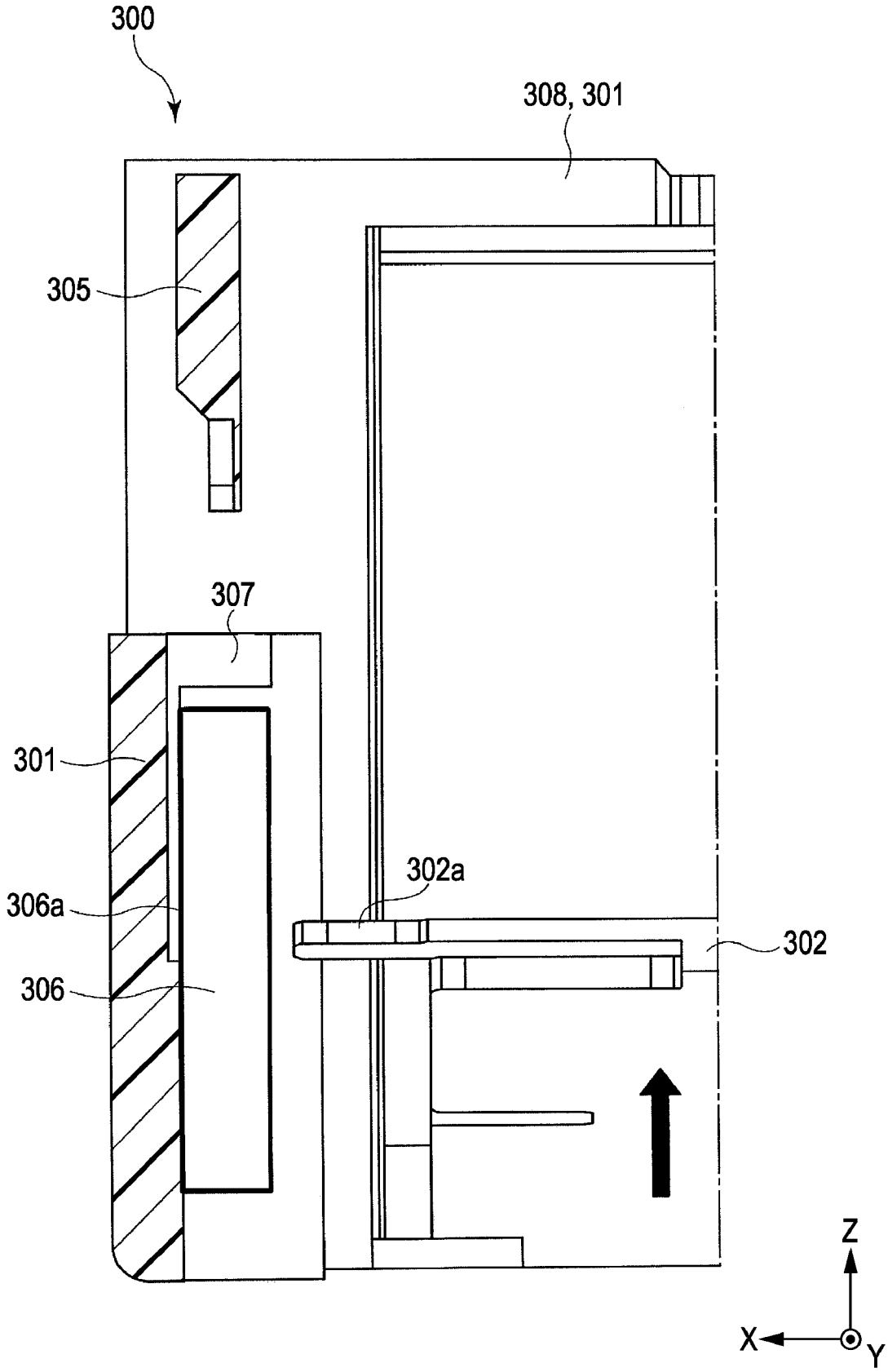
FIG. 20 is an enlarged sectional view of the cassette unit, showing a state in which the cassette hopper further hops up from the state of FIG. 19.

FIG. 19 is an enlarged sectional view of the cassette unit 300, showing a state in which the cassette hopper 302 hops up from the state of FIG. 18. FIG. 20 is an enlarged sectional view of the cassette unit 300, showing a state in which the cassette hopper 302 further hops up from the state of FIG. 19. FIGS. 17 to 20 omit the positioning protrusions 310 for simply describing the state of the locking sections 306.

Figure 21:
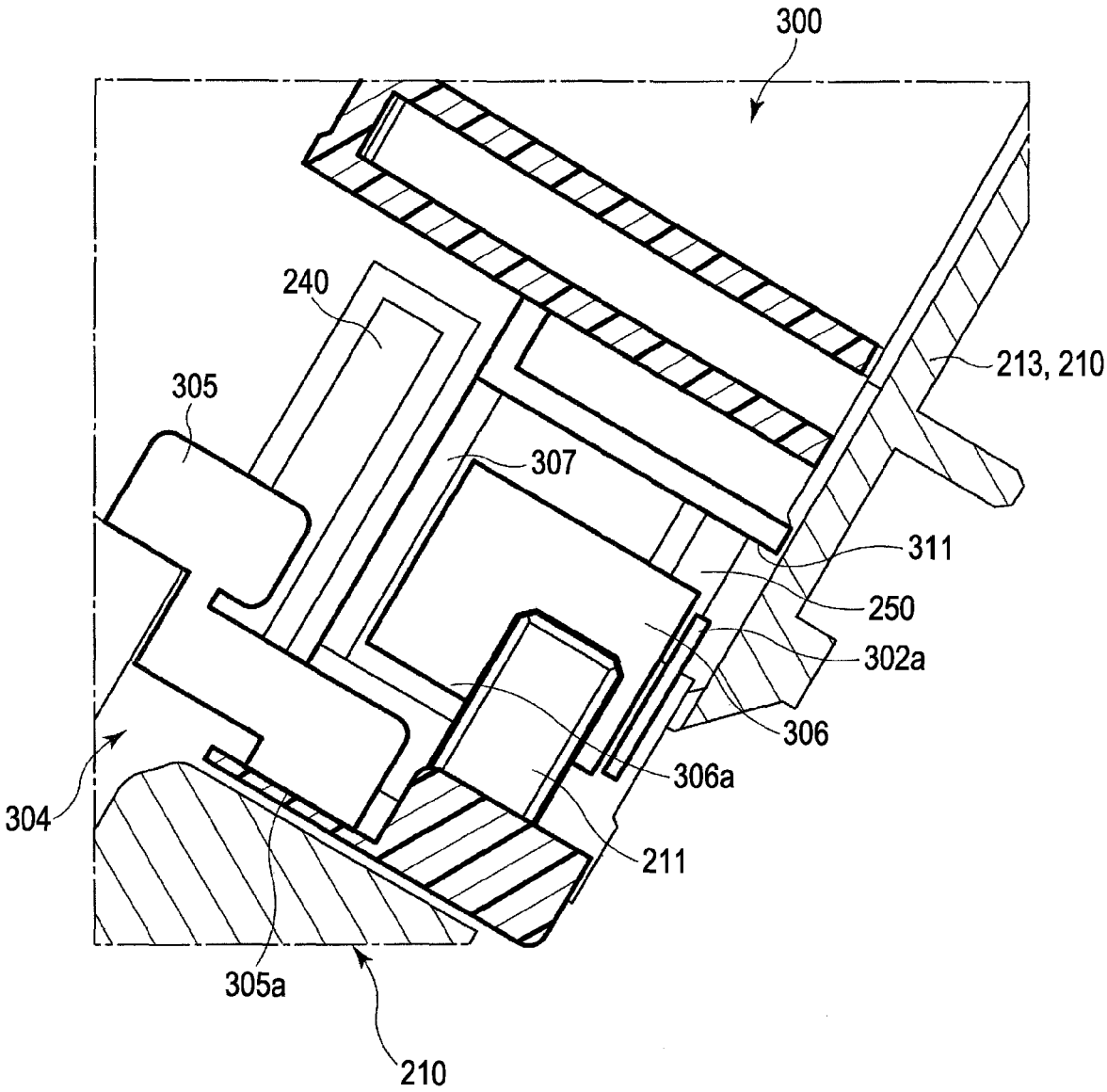
FIG. 21 is a side sectional view of the cassette unit, as viewed from the first column, showing a state in which the mounting of the cassette unit is complete.
Figure 22:
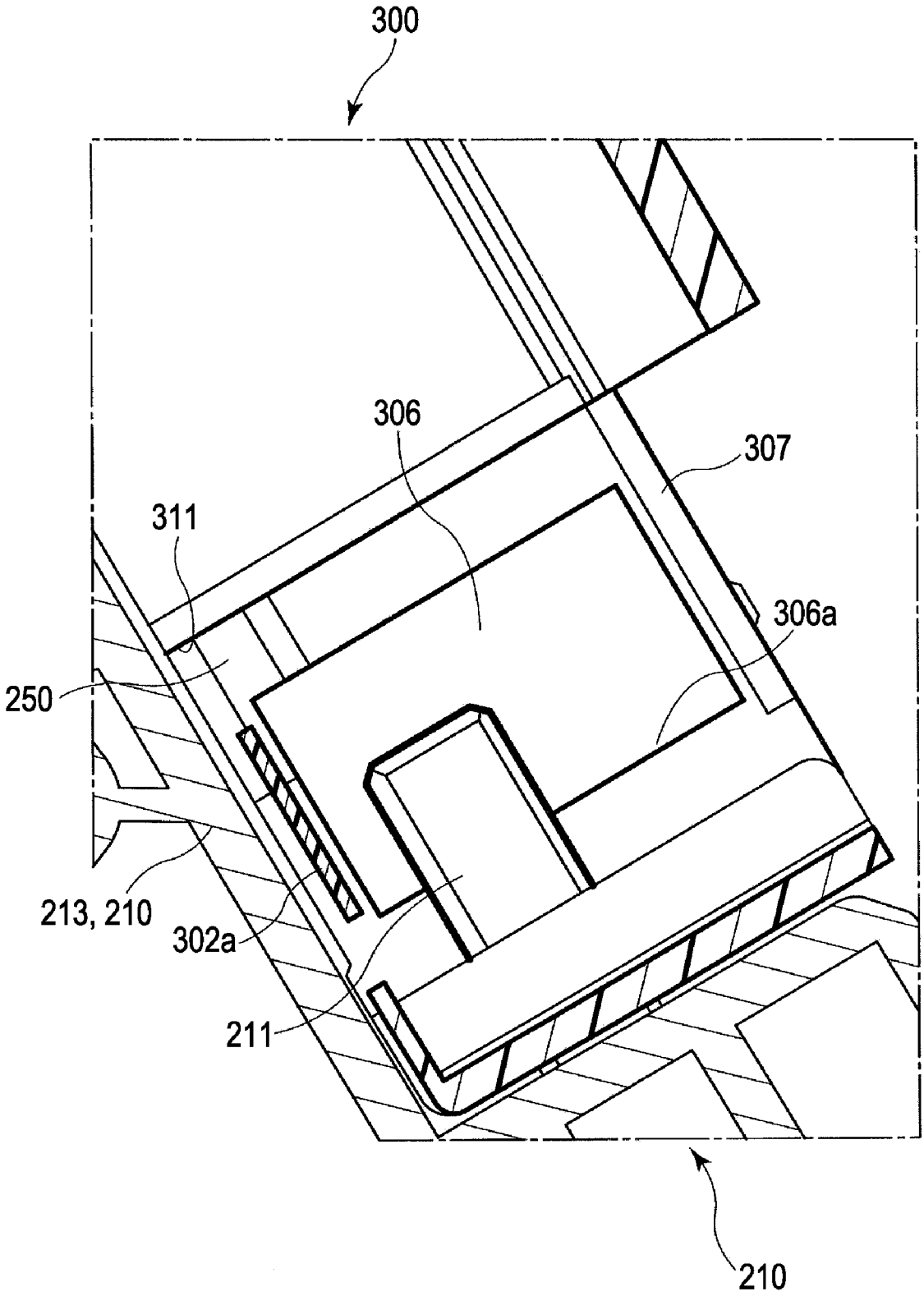
FIG. 22 is a side sectional view of the cassette unit, as viewed from the $80^{th}$ column, showing the state in which the mounting of the cassette unit is complete.

FIG. 21 is a side sectional view of the cassette unit 300, as viewed from the first column, showing a state in which the mounting of the cassette unit 300 is complete. FIG. 22 is a side sectional view of the cassette unit 300, as viewed from the $80^{th}$ column, showing the state in which the mounting of the cassette unit 300 is complete.

As shown in FIGS. 13 to 22, the cassette unit 300 is pushed along the Y-axis when mounted to the recording-apparatus main body 101. At that time, the pair of projections 211 comes into contact with the pair of locking sections 306, which is in contact with the pair of tabs 302*a*. As the cassette unit 300 is gradually pushed in, the projections 211 displace the locking sections 306 outward in the width direction X while elastically deforming the second connecting portions 306*a*. When the cassette unit 300 is further pushed in, the locking sections 306 are further displaced outward to separate from the tabs 302*a*. Thereafter, the cassette unit 300 is further pushed in to complete the mounting.

As described above, when the mounting of the cassette unit 300 is complete, the locking sections 306 are separate from the tabs 302*a*. In other words, the attitude holding by the locking sections 306 is released. This allows the cassette hopper 302 to swing about the first connecting portion 303 without the control of the locking sections 306. That is, the attitude holding can be released using the pushing force when the user mounts the cassette unit 300.

As described above, when the hopper 220 moves toward the feed roller 190 by the rotation of the hopper lever 221, the hopper 220 engages with the cassette hopper 302. At that time, as shown in FIGS. 19 and 20, the cassette hopper 302 moves toward the feed roller 190, together with the hopper 220. When the hopper 220 separates from the feed roller 190, the cassette hopper 302 also separates with the hopper 220.

The direction in which the cassette hopper 302 moves toward and away from the feed roller 190 is the direction of the Z-axis. The direction i which the locking sections 306 are displaced is the direction of the X-axis.

After completion of the job of continuous feeding, the cassette hopper 302 becomes fully released. When the cassette hopper 302 becomes fully released, the hopper 220 further moves away after the cassette hopper 302 is stopped. Thus, the hopper 220 is separate from the cassette hopper 302. When the user dismounts the cassette unit 300 in this state, the locking sections 306 separate from the projections 211 with the movement of the cassette unit 300 in the dismounting direction.

At that time, the elastically deformed second connecting portions 306*a* are acted upon by the force of returning to their original shape. Thus, the locking sections 306 are displaced inward in the width direction X. The distal ends of the locking sections 306 come into agreement with the tabs 302*a* in the direction of the X-axis.

As a result, the attitude of the cassette hopper 302 is again held in its fully released state. In other words, the attitude of the cassette hopper 302 can be held using the movement when the user dismounts the cassette unit 300.

There is a small gap along the Z-axis between the locking sections 306 and the tabs 302*a*. The gap is provided to bring the cassette hopper 302 in its attitude-holding released state to the attitude holding state again. The tabs 302*a* or the locking sections 306 may of course have a slope to decrease the gap.

The feeding section 144 corresponding to a feeding apparatus according to an embodiment of the invention includes the cassette unit 300 and the recording-apparatus main body 101 corresponding to a feeding-apparatus main body. The cassette unit 300 can be mounted and dismounted to/from the recording-apparatus main body 101. The cassette unit 300 includes the cassette casing 301 which is the base member of the cassette unit 300, the movable cassette hopper 302 on which paper P, an example of a housed recording medium, is to be placed, and the pair of locking sections 306 that holds the attitude of the cassette hopper 302. The recording-apparatus main body 101 includes the pair of protrusions 211 corresponding to contact portions that come into contact with the locking sections 306 to release the holding state when the cassette unit 300 is mounted to the recording-apparatus main body 101.

The locking sections 306 are constructed to swingingly project from the casing 301 of the cassette unit 300 so that the distal free ends of the locking sections 306 come into contact with the cassette hopper 302 to hold the attitude of the cassette hopper 302. The distal free ends of the locking sections 306 are thicker than the proximal ends.

The proximal ends of the locking sections 306 are integrated with the casing 301 of the cassette unit 300 with the second connecting portions 306*a* corresponding to connecting portions thinner than the distal free ends. The locking sections 306 swing in the direction Y intersecting the direction Z of the movement of the cassette hopper 302 by the deflection of the second connecting portions 306*a*.

In this embodiment, the cassette hopper 302 can be moved toward and away from the feed roller 190 of the recording-apparatus main body 101; and the locking sections 306 hold the attitude of the cassette hopper 302 when the cassette hopper 302 is most apart from the feed roller 190 in the moving range.

In this embodiment, the locking sections 306 have inward urging force in the width direction X, which is the direction of approaching the cassette hopper 302. When the projections 211 come into contact with the locking sections 306, the locking sections 306 separate from the cassette hopper 302. When the projections 211 separate from the locking sections 306, the locking sections 306 come into contact with the cassette hopper 302.

In this embodiment, the locking sections 306 are elastically deformed together with the cassette casing 301, which is the casing of the cassette unit 300.

In this embodiment, the direction of the X-axis in which the locking sections 306 are displaced intersects the direction of the Y-axis in which the cassette hopper 302 moves; and the cassette casing 301 has the pair of locked-attitude holding portions 307 serving as attitude stabilizing portions, at positions adjacent to the feed roller 190 with respect to the locking sections 306, for preventing the displacement of the locking sections 306 in the direction of the Z-axis, which is the direction of the movement of the cassette hopper 302.

In this embodiment, the locked-attitude holding portions 307 include the inner surface 309 of the cassette front surface 308, which is the surface of the cassette casing 301 adjacent to the feed roller 190; and the locking sections 306 can come into contact with the inner surface 309.

The recording apparatus 100 of this embodiment includes the feeding section 144 for feeding the paper P placed thereon and the recording section 143 for recording the paper P fed from the feeding section 144 using the recording head 106.

Although the locking sections 306 of this embodiment are constructed to hold the attitude of the cassette hopper 302 in its fully released state, the invention is not limited to that. With a structure in which the cassette hopper 302 is retracted every feeding by the thickness of a few sheet of paper, the retracted attitude may be held. In this case, the attitude can be held in the cassette unit 300, with the gap between the paper P and the cassette casing 301 reduced. This reduces the movement of the paper P when the cassette unit 300 fluctuates. This reduces damage to the paper P due to the movement of the paper P.

Second Embodiment

Figure 23B:
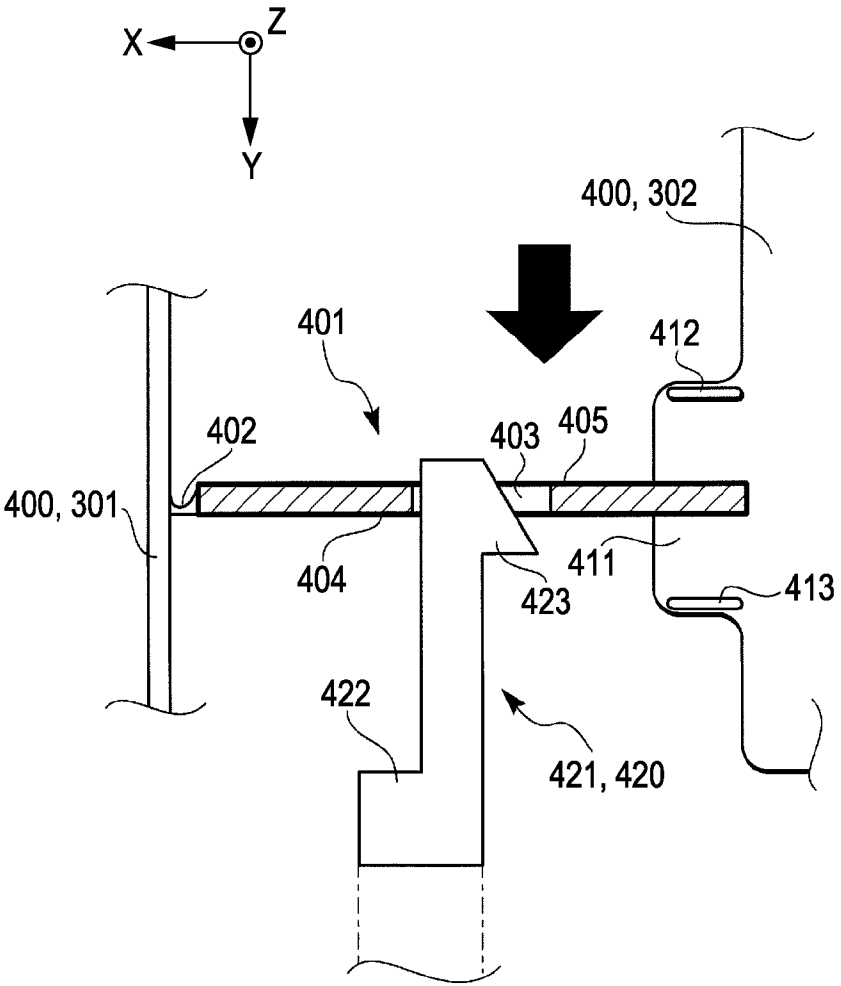
FIG. 23B is a diagram of the projection and the locking section, showing a state in which the cassette unit according to the second embodiment is being mounted.
Figure 23A:
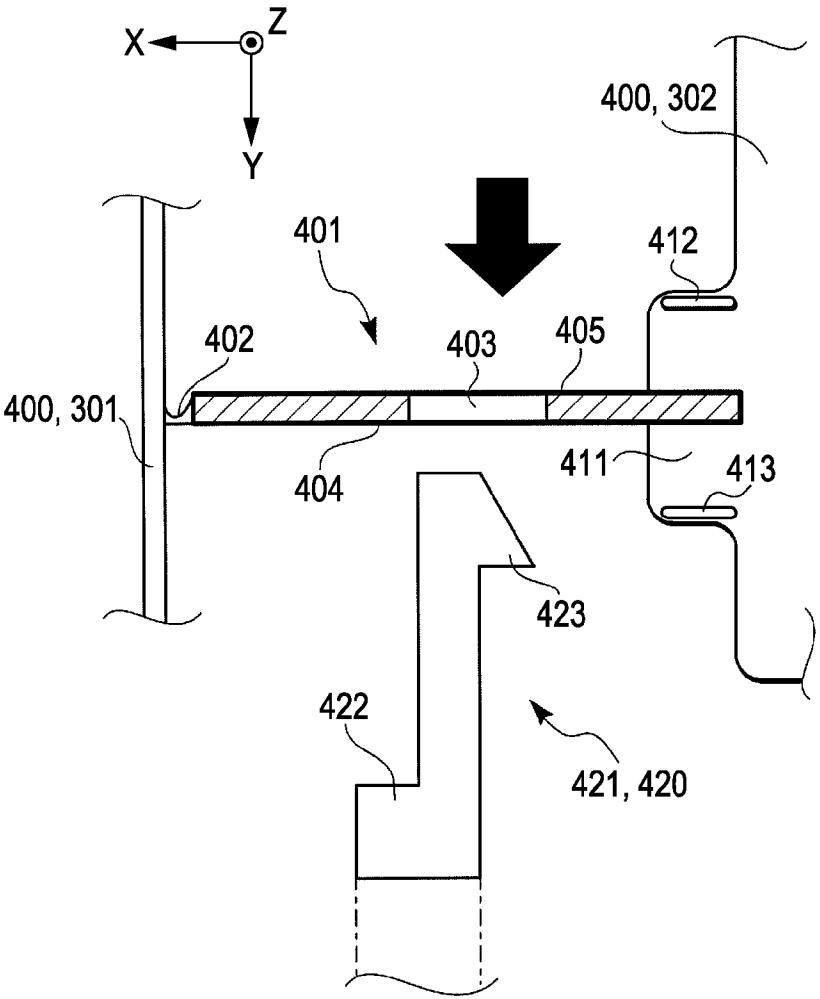
FIG. 23A is a diagram of the projection and the locking section, showing a state just before a cassette unit according to a second embodiment is mounted.

FIGS. 23A and 23B are enlarged front views of essential parts, a projection 421 and a locking section 401, of a cassette unit 400 according to a second embodiment, showing the mounting of the cassette unit 400. FIG. 23A shows a state just before the cassette unit 400 is mounted to a recording-apparatus main body 420. FIG. 23B shows a state in which the cassette unit 400 is being mounted to the recording-apparatus main body 420.

Since components that are not particularly referred to are the same as those of the first embodiment, the same numerals are given and their description will be omitted.

As shown in FIG. 23A, the cassette unit 400 of the second embodiment includes a cassette hopper 302 and a pair of locking levers 401 for locking the attitude of the cassette hopper 302. The cassette hopper 302 can be moved toward and away from the feed roller 190, as in the first embodiment. The cassette hopper 302 has a pair of tabs 411, which are protrusions, on widthwise either side.

Since the pair of locking levers 401 and the projections 421 are symmetrical, only the components on the left will be described and descriptions of the components on the right will be omitted.

The locking levers 401 can lock the cassette hopper 302 in its hopped-down state, like the locking sections 306 of the first embodiment. Specifically, the locking levers 401 are disposed in the vicinity of the tabs 411. The locking levers 401 each have a lever connecting portion 402, a hole 403, a first engaged portion 404, and a second engaged portion 405. The lever connecting portion 402 connects the locking lever 401 with the cassette casing 301. In a word, the locking lever 401 is integrated with the cassette casing 301. The lever connecting portion 402 is thinner than the body of the locking lever 401. This allows the locking lever 401 to swing by the elastic deformation of the lever connecting portion 402.

The components of the cassette unit 400 are integrally formed of a flexible material, as in the first embodiment.

The hole 403 allows part of the distal end of the projection 421 of the recording-apparatus main body 420, to be described later, to pass through. The first engaged portion 404 can engage with a base 422, or a first engaging portion, of the projection 421, to be described later. The second engaged portion 405 can engage with a hook 423, or a second engaging portion, of the projection 421, to be described later. The distal end of the locking lever 401 comes into contact with the tab 411 of the cassette hopper 302 to lock the cassette hopper 302 in its hopped-down state.

FIG. 23A shows a state in which the attitude of the cassette hopper 302 is locked by the locking lever 401.

The recording-apparatus main body 420 has the pair of projections 421, which can come into contact with the locking levers 401 of the cassette unit 400 at the positions opposed to the locking levers 401 in such a manner as to project in the direction in which the cassette unit 400 is dismounted. The projection 421 has the base 422, or the first engaging portion, at the proximal end, and the hook 423, or the second engaging portion, at the distal end. The base 422 is a step that is to engage with the first engaged portion 404 of the locking lever 401. The hook 423 is to engage with the second engaged portion 405 of the locking lever 401. The part of the projection 421 adjacent to the distal end relative to the base 422 can be inserted into the hole 403 of the locking lever 401.

The tabs 411 of the cassette hopper 302 each have a first stopper 412 and a second stopper 413 for stabilizing the attitude of the locking lever 401. The first stopper 412 and the second stopper 413 are ridges protruding from the tab 411 in the direction of the Z-axis. When a predetermined force is applied to the locking lever 401, the distal end of the locking lever 401 deflects a little to get over the first stopper 412 and separates from the tab 411, or to get over the first stopper 412 and agrees with the tab 411 in the directions of the X-axis and the Y-axis into a locked state.

The second stopper 413 is constructed not to allow the distal end of the locking lever 401 to get over.

As shown in FIG. 23B, when the cassette unit 400 is moved from the state in FIG. 23A in the mounting direction Y, the locking lever 401 approaches the projection 421. The hook 423 at the distal end of the projection 421 is inserted into the hole 403 of the locking lever 401. At that time, the projection 421 has not yet acted onto the locking lever 401.

Figure 24B:
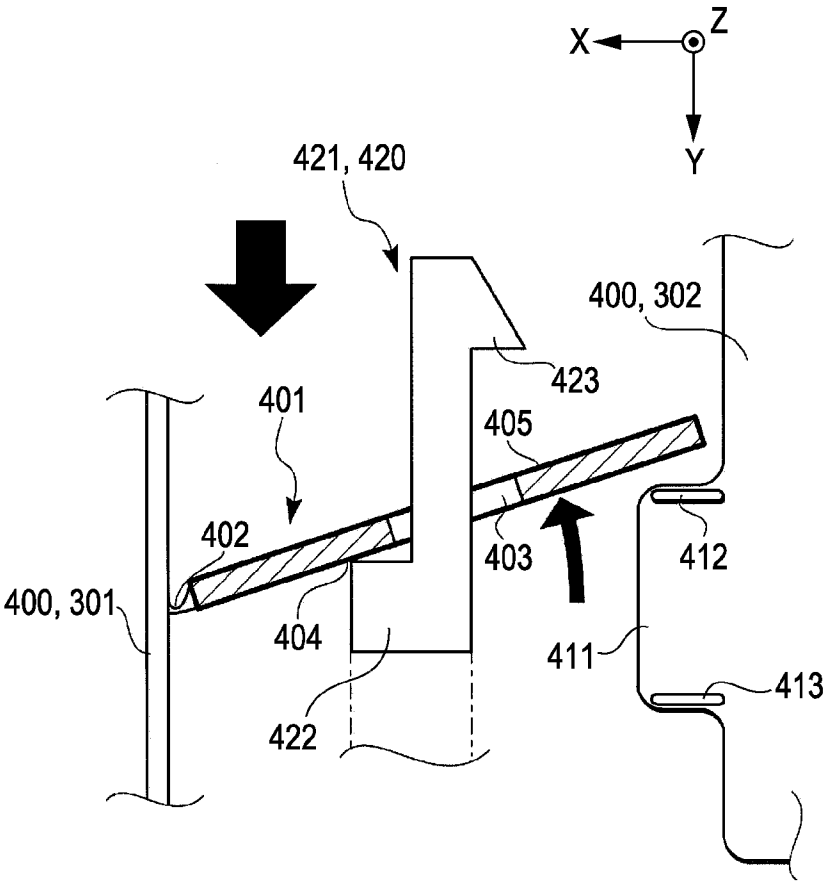
FIG. 24B is a diagram of the projection and the locking section, showing a state in which the mounting of the cassette unit according to the second embodiment is complete.
Figure 24A:
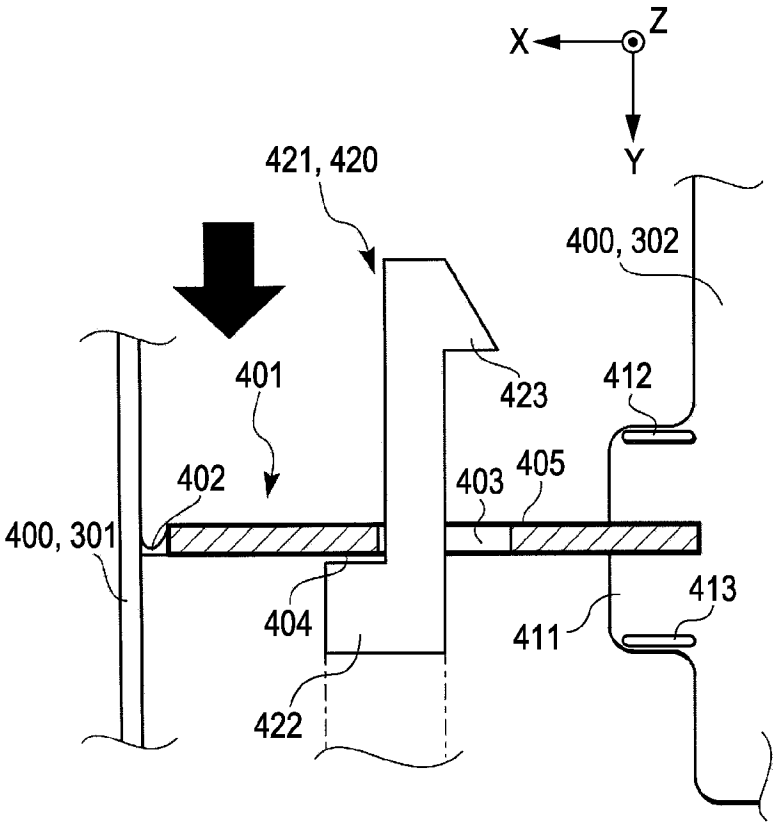
FIG. 24A is a diagram of the projection and the locking section, showing a state in which the cassette unit according to the second embodiment is being mounted.

FIGS. 24A and 24B are enlarged front views of the essential parts, the projection 421 and the locking section 401, of the cassette unit 400 according to the second embodiment, showing completion of the mounting. FIG. 24A shows a state in which the cassette unit 400 is being mounted to the recording-apparatus main body 420. FIG. 24B shows a state in which the mounting of the cassette unit 400 to the recording-apparatus main body 420 is complete.

As shown in FIG. 24A, when the cassette unit 400 is further moved from the state shown in FIG. 23B in the mounting direction Y, the locking lever 401 further approaches the projection 421. The hook 423 of the projection 421 passes through the hole 403 of the locking lever 401. The first engaged portion 404 of the locking lever 401 approaches the base 422 of the projection 421. At that time, the projection 421 has not acted onto the locking lever 401.

As shown in FIG. 24B, when the cassette unit 400 is further moved from the state shown in FIG. 24A in the mounting direction Y, the first engaged portion 404 of the locking lever 401 comes into contact with the base 422 of the projection 421. Thus the locking lever 401 is pushed up from the cassette unit 400 by the base 422. In other words, the locking lever 401 swings counterclockwise about the lever connecting portion 402.

As a result, the distal end of the locking lever 401 is pushed up to get over the first stopper 412 and separates from the tab 411 of the cassette hopper 302. Thus, the cassette hopper 302 is unlocked to be allowed to move toward and away from the feed roller 190. The positioning protrusion 310 (see FIG. 13) of the cassette unit 400 comes into contact with the holding portion 212 (see FIG. 13) of the recording-apparatus main body 420 to complete the mounting of the cassette unit 400 to the recording-apparatus main body 420.

Dismounting of the cassette unit 400 from the recording-apparatus main body 420 will be described.

Figure 25B:
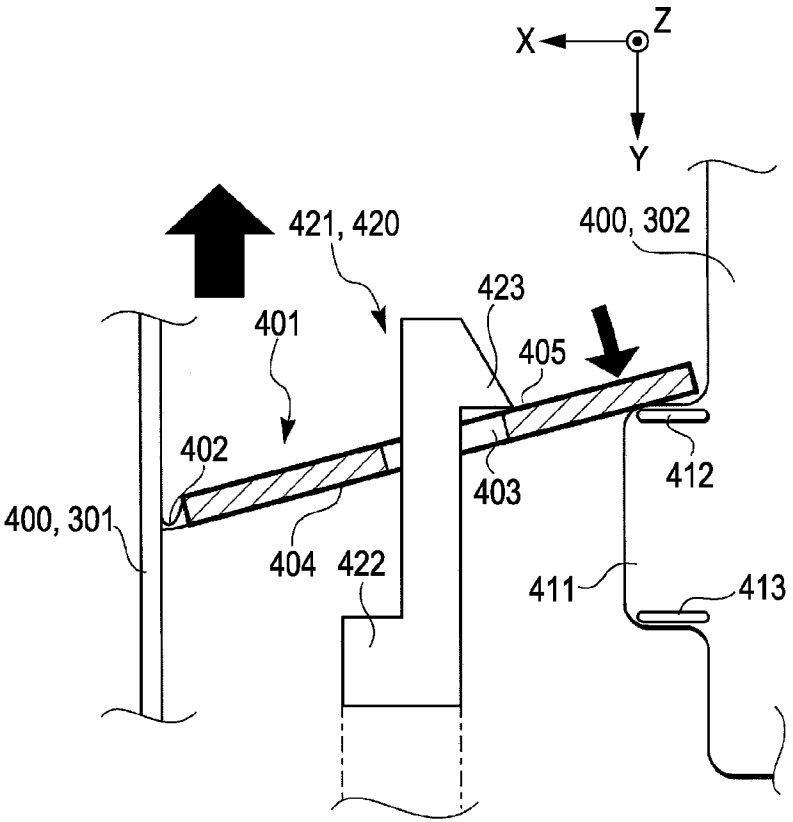
FIG. 25B is a diagram of the projection and the locking section, showing a state in which the cassette unit according to the second embodiment is moved in the dismounting direction from the state in FIG. 25A.
Figure 25A:
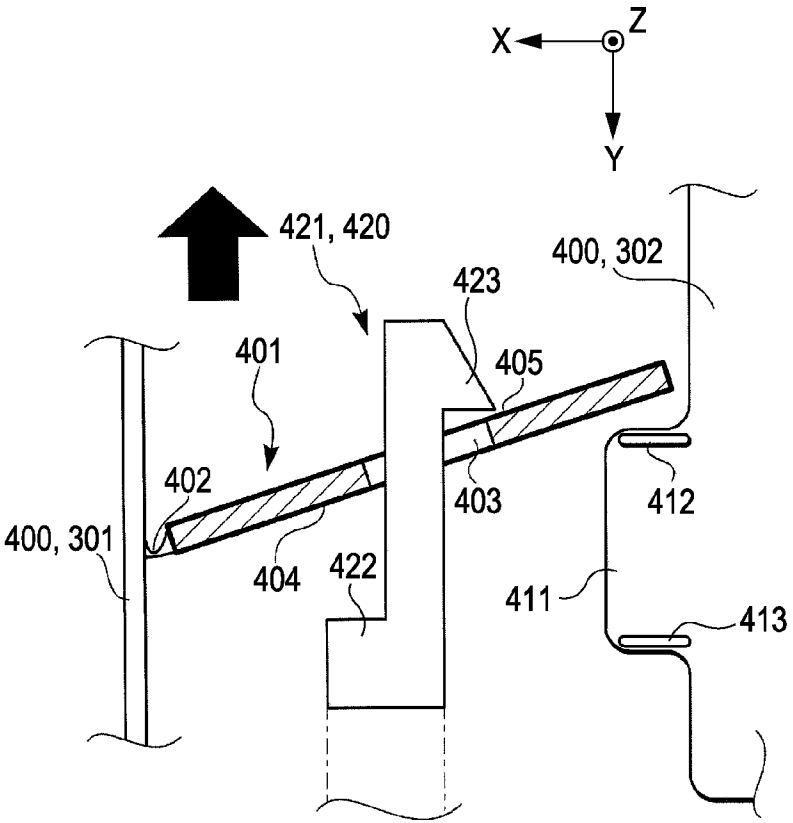
FIG. 25A is a diagram of the projection and the locking section, showing a state just after the dismounting of the cassette unit according to the second embodiment is started.

FIGS. 25A and 25B are enlarged front views of the essential parts, the projection 421 and the locking section 401, of the cassette unit 400 according to the second embodiment, showing dismounting of the cassette unit 400. FIG. 25A shows a state just after the dismounting of the cassette unit 400 is started. FIG. 25B shows a state in which the cassette unit 400 is moved in the dismounting direction from the state in FIG. 25A.

As shown in FIG. 25A, when the cassette unit 400 is moved from the state in FIG. 24B in the dismounting direction (opposite to the arrow Y), the first engaged portion 404 of the locking lever 401 separates from the base 422 of the projection 421. The second engaged portion 405 of the locking lever 401 approaches the hook 423 of the projection 421. At that time, the projection 421 has not yet acted onto the locking lever 401.

As shown in FIG. 25B, when the cassette unit 400 is further moved from the state shown in FIG. 25A in the dismounting direction (opposite to the arrow Y), the second engaged portion 405 of the locking lever 401 comes into contact with the hook 423 of the projection 421. Thus, the locking lever 401 is pushed down from the cassette unit 400 by the hook 423. In other words, the locking lever 401 rotates clockwise about the lever connecting portion 402. Thus the distal end of the locking lever 401 comes into contact with the first stopper 412 of the tab 411.

Figure 26B:
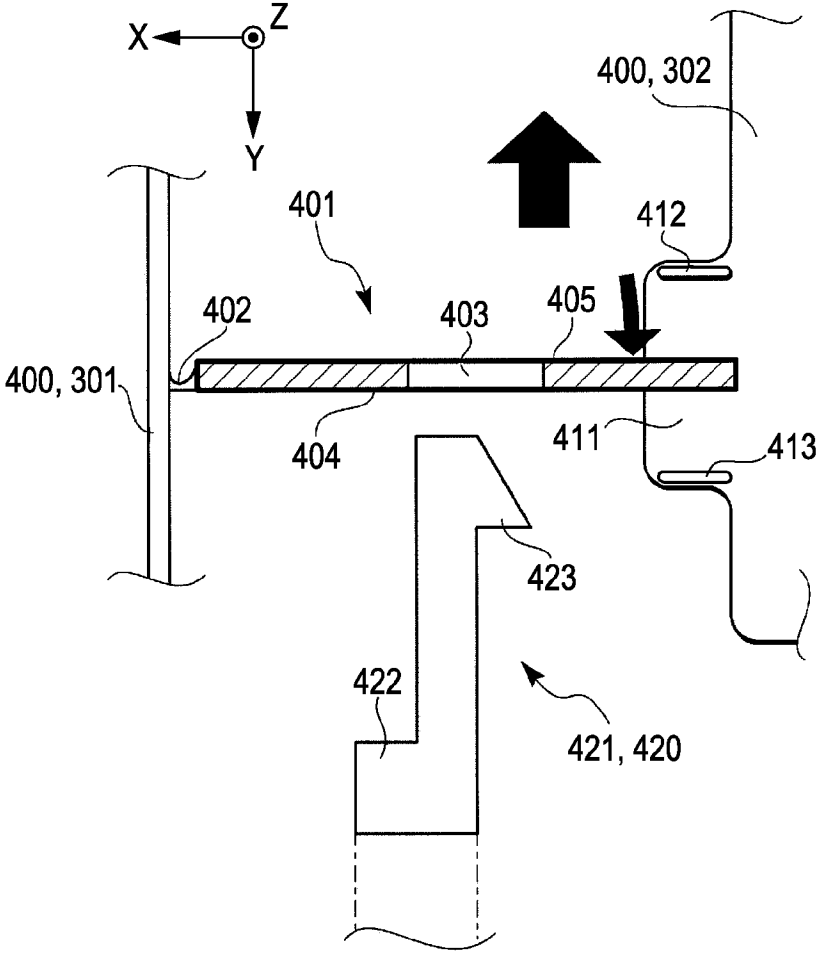
FIG. 26B is a diagram of the projection and the locking section, showing a state in which the dismounting of the cassette unit according to the second embodiment is complete.
Figure 26A:
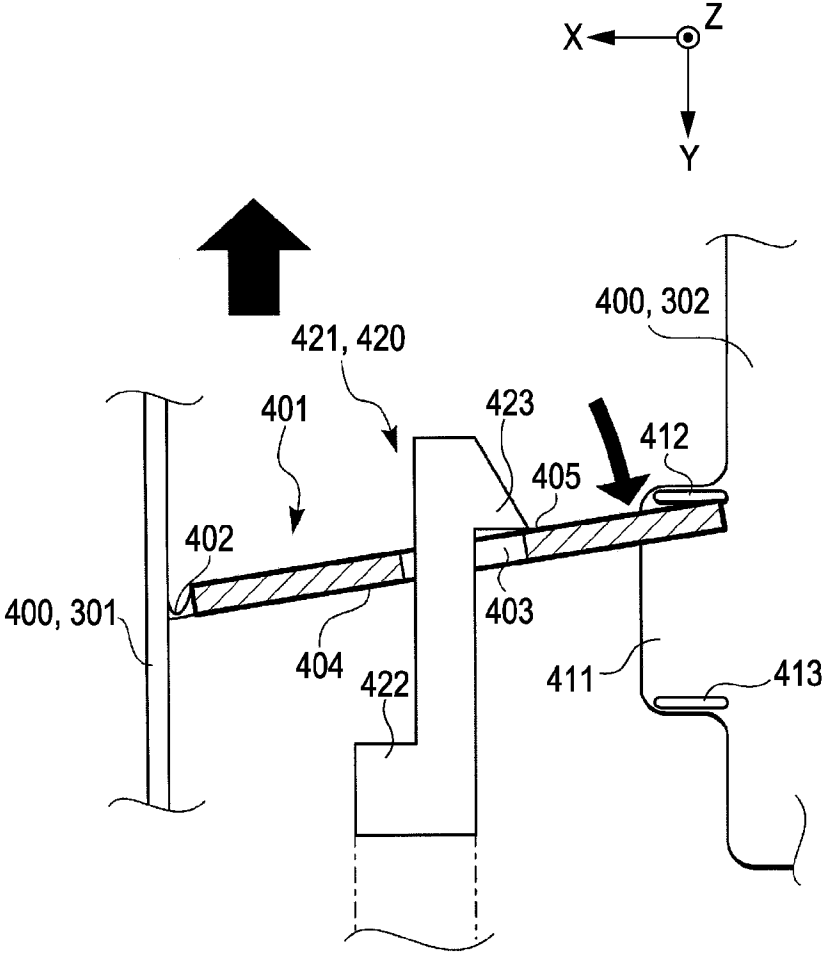
FIG. 26A is a diagram of the projection and the locking section, showing a state in which the cassette unit according to the second embodiment is locked by the locking section.

FIGS. 26A and 26B are enlarged front views of the essential parts, the projection 421 and the locking section 401, of the cassette unit 400 according to the second embodiment, showing completion of the dismounting. FIG. 26A shows a state in which the cassette unit 400 is locked by the locking lever 401. FIG. 26B shows a state in which the dismounting of the cassette unit 400 from the recording-apparatus main body 420 is complete.

As shown in FIG. 26A, the cassette unit 400 is further moved from the state shown in FIG. 25B in the dismounting direction (opposite to the arrow Y). At that time, the hook 423 of the projection 421 is in tight engagement with the second engaged portion 405 of the locking lever 401. This allows the hook 423 to forcibly rotate the locking lever 401 clockwise.

As a result, the distal end of the locking lever 401 is pushed down to get over the first stopper 412 and comes into contact with the tab 411 of the cassette hopper 302. Thus, the distal end of the locking lever 401 and the tab 411 agrees with each other in the directions of the X-axis and the Y-axis to lock the cassette hopper 302.

Thereafter, the hook 423 further rotates the locking lever 401 clockwise by engagement with the second engaged portion 405 as the cassette unit 400 moves in the dismounting direction.

Since the projection 421 passes through the hole 403, there is no possibility of disagreement of the positions of the hook 423 and the second engaged portion 405. That is, the hook 423 engages tightly with the second engaged portion 405 to allow the locking lever 401 to rotate clockwise. In other words, even if the attitude of the second engaged portion 405 shifts in the direction of the Z-axis because of the deflection of the distal end of the locking lever 401, the hole 403 allows the hook 423 to engage tightly with the second engaged portion 405 so that the locking lever 401 rotates clockwise.

As shown in FIG. 26B, the cassette unit 400 is further moved from the state shown in FIG. 26A in the dismounting direction (opposite to the arrow Y).

The hole 403 and the second engaged portion 405 of the locking lever 401 are constructed such that the engagement between the hook 423 and the second engaged portion 405 is released when the distal end of the locking lever 401 comes between the first stopper 412 and the second stopper 413 of the tab 411. In other words, when the locking lever 401 engages with the tab 411 into a locked state in the range of the movement of the hole 403 of the locking lever 401, the hook 423 and the hole 403 come to the same position in the direction of the X-axis and a gap is produced between the hook 423 and the second engaged portion 405.

This allows the hook 423 to forcibly rotate the locking lever 401 clockwise until the distal end of the locking lever 401 comes between the first stopper 412 and the second stopper 413 of the tab 411. Thereafter, with the cassette hopper 302 in its locked state, the engagement between the hook 423 and the second engaged portion 405 is released so that no force is acted on the locking lever 401. Thus, the hook 423 passes smoothly through the hole 403 to complete the dismounting of the cassette unit 400 from the recording-apparatus main body 420.

According to the second embodiment, the projection 421 corresponding to a contact portion includes the base 422 corresponding to a first engaging portion and the hook 423 corresponding to a second engaging portion. The base 422 engages with the locking lever 401 corresponding to a locking section to release a state in which the locking lever 401 holds the attitude of the cassette hopper 302 when the cassette unit 400 is mounted to the feeding-apparatus main body 420. The hook 423 engages with the locking lever 401 to make the locking lever 401 hold the attitude of the cassette hopper 302 when the cassette unit 400 is dismounted from the feeding-apparatus main body 420.

In the second embodiment, the projection 421 projects in the direction in which the cassette unit 400 is dismounted; the first engaging portion is the base 422 corresponding to a step at the proximal end of the projection 421; and the second engaging portion is the hook 423 at the distal end of the projection 421.

In the second embodiment, when the cassette unit 400 is dismounted from the feeding-apparatus main body 420, the hook 423 engages with the locking lever 401 and swings the locking lever 401 so that the locking lever 401 holds the attitude of the cassette hopper 302; and the swing of the locking lever 401 causes a gap between the hook 423 and the locking lever 401 to release the engagement between the hook 423 and the locking lever 401.

In the second embodiment, the cassette hopper 302 includes the first stopper 412 and the second stopper 413 corresponding to an attitude stabilizing portion that can be engaged with the locking lever 401 to stabilize the attitude of the locking lever 401 while the locking lever 401 is holding the attitude of the cassette hopper 302.

The lever connecting portion 402 may not necessarily be elastically deformed; it may have a hinge structure.

The distal end of the locking lever 401 may of course be thick as in the first embodiment.

It will be obvious to those skilled in the art that the invention is not limited to the foregoing embodiments and changes and modifications may be made without departing from the scope of the following claims and included within the scope of the invention.

What is claimed is:

1. A feeding apparatus comprising:

a cassette unit; and a feeding-apparatus main body, wherein the cassette unit can be mounted to and dismounted from the feeding-apparatus main body, the cassette unit including a casing, a movable cassette hopper on which a housed recording medium is to be placed, and a locking section that projects inward from a side of the casing and incline against the cassette hopper when it is inserted, such that the locking section swings in a width direction of the housed recording medium so as to hold the attitude of the cassette hopper; and the feeding-apparatus main body includes a contact portion which projects from an opening in a base portion of the casing and comes into contact with the locking section when the casing of the cassette unit is mounted to the feeding apparatus main body, causing the locking section to swing in the width direction so as to release a holding state wherein the attitude of the cassette hopper is held, wherein the locking section swings so as to project from the casing of the cassette unit so that a distal free end of the locking section comes into contact with the cassette hopper to hold the attitude of the cassette hopper, wherein the distal free end of the locking section is thicker than a proximal end of the locking section, wherein the proximal end of the locking section is integrated with the casing of the cassette unit with a connecting portion which is thinner than the distal free end of the locking section, wherein the locking section swings in the width direction which intersects a direction of a movement of the cassette hopper by the deflection of the connecting portion, wherein when the locking section does not come into contact with the contact portion, the locking section engages with a tab of the cassette hopper, wherein when the locking section comes into contact with the contact portion, the contact portions elastically deform the locking sections outward, such that the locking section does not engage with the tab of the cassette hopper, wherein the contact portion includes:

a first engaging portion that engages with the locking section as the cassette unit is mounted to the feeding-apparatus main body in order to release a state in which the locking section holds the attitude of the cassette hopper; and a second engaging portion that engages with the locking section as the cassette unit is dismounted from the feeding-apparatus main body to make the locking section hold the attitude of the cassette hopper, and wherein the contact portion projects in the direction in which the cassette unit is dismounted, the first engaging portion is a step at a proximal end of the contact portion, and the second engaging portion is a hook at a distal end of the contact portion.

2. The feeding apparatus according to claim 1, wherein:

as the cassette unit is dismounted from the feeding-apparatus main body, the second engaging portion engages with the locking section and swings the locking section to make the locking section hold the attitude of the cassette hopper; and the swing of the locking section causes a gap between the second engaging portion and the locking section to release the engagement between the second engaging portion and the locking section.

3. The feeding apparatus according to claim 1, wherein:

the cassette hopper includes an attitude stabilizing portion that can be engaged with the locking section to stabilize the attitude of the locking section while the locking section is holding the attitude of the cassette hopper.

4. A feeding apparatus comprising:

a cassette unit; and a feeding-apparatus main body, wherein the cassette unit can be mounted to and dismounted from the feeding-apparatus main body, the cassette unit including a casing, a movable cassette hopper on which a housed recording medium is to be placed, and a locking section that projects inward from a side of the casing and incline against the cassette hopper when it is inserted, such that the locking section swings in a width direction of the housed recording medium so as to hold the attitude of the cassette hopper; and the feeding-apparatus main body includes a contact portion which projects from an opening in a base portion of the casing and comes into contact with the locking section when the casing of the cassette unit is mounted to the feeding apparatus main body, causing the locking section to swing in the width direction so as to release a holding state wherein the attitude of the cassette hopper is held, wherein the locking section swings so as to project from the casing of the cassette unit so that a distal free end of the locking section comes into contact with the cassette hopper to hold the attitude of the cassette hopper, wherein the distal free end of the locking section is thicker than a proximal end of the locking section, wherein the proximal end of the locking section is integrated with the casing of the cassette unit with a connecting portion which is thinner than the distal free end of the locking section, wherein the locking section swings in the width direction which intersects a direction of a movement of the cassette hopper by the deflection of the connecting portion, wherein when the locking section does not come into contact with the contact portion, the locking section engages with a tab of the cassette hopper, wherein when the locking section comes into contact with the contact portion, the contact portions elastically deform the locking sections outward, such that the locking section does not engage with the tab of the cassette hopper, wherein the contact portion includes:

a first engaging portion that engages with the locking section as the cassette unit is mounted to the feeding-apparatus main body in order to release a state in which the locking section holds the attitude of the cassette hopper; and a second engaging portion that engages with the locking section as the cassette unit is dismounted from the feeding-apparatus main body to make the locking section hold the attitude of the cassette hopper, and wherein as the cassette unit is dismounted from the feeding-apparatus main body, the second engaging portion engages with the locking section and swings the locking section to make the locking section hold the attitude of the cassette hopper; and the swing of the locking section causes a gap between the second engaging portion and the locking section to release the engagement between the second engaging portion and the locking section.

5. The feeding apparatus according to claim 4, wherein:

the cassette hopper includes an attitude stabilizing portion that can be engaged with the locking section to stabilize the attitude of the locking section while the locking section is holding the attitude of the cassette hopper.

* * * * *